United States Patent [19]

Yamada et al.

[11] Patent Number: 4,678,743

[45] Date of Patent: Jul. 7, 1987

[54] SILVER HALIDE COLOR PHOTOGRAPHIC MATERIAL

[75] Inventors: Kohzaburoh Yamada; Seiji Ichijima; Hideo Usui, all of Kanagawa, Japan

[73] Assignee: Fuji Photo Film Co., Ltd., Kanagawa, Japan

[21] Appl. No.: 793,064

[22] Filed: Oct. 30, 1985

[30] Foreign Application Priority Data

Oct. 30, 1984 [JP] Japan ..... 59-228642

[51] Int. Cl.[4] ..... G03C 1/40; G03C 7/32

[52] U.S. Cl. ..... 430/551; 430/553; 430/555; 430/557; 430/558; 430/955; 430/959

[58] Field of Search ..... 430/551, 955, 959, , 430/957, 553, 555, 557, 558, 372

[56] References Cited

U.S. PATENT DOCUMENTS 4,248,962 2/1981 Lau ..... 430/957
4,358,525 11/1982 Mooberry et al. ..... 430/957
4,409,323 10/1983 Sato et al. ..... 430/957
4,482,629 11/1984 Nakagawa et al. ..... 430/551
4,618,571 10/1986 Ichijima et al. ..... 430/959

FOREIGN PATENT DOCUMENTS 0138636 8/1982 Japan .

*Primary Examiner*—Richard L. Schilling
*Attorney, Agent, or Firm*—Sughrue, Mion, Zinn, Macpeak & Seas

[57] ABSTRACT

A silver halide color photographic material is described, comprising a support having thereon at least a light-sensitive silver halide and a coupler represented by the general formula: A-RED-P, wherein A is a coupler residue capable of cleaving RED-P on reacting with an oxidized color developing agent, P is a group capable of releasing RED after cleavage of RED-P from A, and RED is a group capable of undergoing an oxidation reduction reaction with the oxidized color developing agent only after the cleavage of A and P. This material is greatly improved in sharpness and graininess.

9 Claims, No Drawings

SILVER HALIDE COLOR PHOTOGRAPHIC MATERIAL

FIELD OF THE INVENTION

The present invention relates to color photography. More particularly, it is concerned with a silver halide color photographic material containing a photographic coupler to improve sharpness and graininess.

BACKGROUND OF THE INVENTION

As is well known, upon color development of a silver halide color photographic material, an oxidized aromatic primary amine color developing agent reacts with a coupler to form a dye such as indophenol, indoaniline, indamine, azomethine, phenoxanine, and phenazine, thereby producing a dye image. In this system, the subtractive color process is employed for color reproduction; silver halide emulsions selectively sensitive to blue, green and red, and color image forming agents in a complementary color relation of yellow, magenta and cyan, respectively, are used. An acylacetanilide- or dibenzoylmethane-based coupler, for example, is used to form a yellow color-image; a pyrazolone-, pyrazolobenzimidazole-, cyanoacetophenone-, or indazolone-based coupler is generally used to form a magenta color image; and a phenol-based coupler (e.g., phenols and naphthols) is generally used to form a cyan color image.

In recent years, with the use of disc cameras and 110 format cameras, it has been increasingly desired to increase the quality of a silver halide photographic material, particularly a color photographic material. In particular, the improvement of sharpness and graininess is important.

It is known to use a coupler not only to form a dye image, but also to release a photographically useful group. Such compounds releasing a photographically useful group are used for various purposes such as improvement of graininess, increase of sharpness, and increase of sensitivity.

A new coupler has been proposed in which a compound capable of capturing an oxidized color developing agent is linked to the coupling position of the coupler. Such couplers are used to trap imagewise the oxidized color developing agent formed according to an exposure amount so that the graininess and gradation of the image can be controlled without deterioration of sensitivity. Typical examples of the couplers are (1) couplers as described in Japanese Patent Application (OPI) Nos. 150631/77 (corresponding to U.S. Pat. No. 4,130,427) and 111537/82 (the term "OPI" as used herein refers to a "published unexamined Japanese patent application") in which a white coupler, or a diffusion type coupler forming a dye capable of flowing out from the photographic material is linked in the coupling position, and (2) couplers as described in Japanese Patent Application (OPI) No. 138636/82 which are substituted with a compound capable of cross oxidation with an oxidized color developing agent and of reducing the oxidized product into the color developing agent, in the coupling position thereof.

Although the above compounds have proved effective in controlling the graininess and gradation of dye images, they have several disadvantages. One of the disadvantages is that a reduction in sensitivity is observed. Another disadvantage is that the effect of controlling the graininess and gradation is generally poor and, furthermore, unlike known DIR couplers they cannot improve sharpness. Still another disadvantage is that they are not expected to increase color reproductivity by exerting an interlayer effect on other layers and, in fact, they do not have this effect. This is believed to be due to the fact that the diffusibility of the compound per se, which is capable of capturing the oxidized color developing agent released from the coupler, is small.

SUMMARY OF THE INVENTION

An object of the present invention is to provide a novel functional coupler which is excellent not only in control of the graininess and gradation of dye images, but also in improvement of the sharpness of the images and of color reproductivity due to an interlayer effect.

It has been found that the object can be attained by using a coupler represented by the general formula (I) as described hereinafter.

Accordingly, the present invention relates to a silver halide color photographic material comprising a support having thereon at least a light-sensitive silver halide and a coupler represented by the general formula (I):

$$\text{A-RED-P} \qquad \text{(I)}$$

wherein A is a coupler residue capable of cleaving RED-P on reacting with an oxidized color developing agent, P is a group capable of releasing RED after cleavage of RED-P from A, and RED is a group capable of undergoing an oxidation/reduction reaction with the oxidized color developing agent only after cleavage of A and P.

DETAILED DESCRIPTION OF THE INVENTION

One of the features of the present invention is that the compound (RED) capable of capturing the oxidized color developing agent (this compound is hereinafter referred to as a "scavenger") is not directly released through reaction with the oxidized color developing agent, but is first cleaved from the coupler as a precursor (RED-P) and thereafter released in the photographic material only after decomposition of P. That is, P acts as a timing controlling group to release the scavenger. By the action of P, the diffusibility of the scavenger can be controlled.

An excess of oxidized color developing agent formed during the process of development can be effectively captured and removed by using the coupler of the present invention. Thus, individual dye clouds are not coarsened to an extent more than necessary, the formation of mottle is prevented, and graininess is improved. Moreover, since it is possible to provide the scavenger with suitable diffusibility, improved sharpness and an interlayer effect could be observed. This effect was observed particularly in the color reversal photographic material. It is known that a coupler releasing a development inhibitor (DIR coupler), for example, can be used to improve the edge effect and interlayer effect. In fact, however, conventional DIR couplers have not been used in color reversal photographic materials because they do not have a development inhibiting effect. This is due to the fact that an inhibitor of the type that is adsorbed on silver halide is used in conventional DIR couplers, and such a development inhibitor cannot be used efficiently in color reversal processing of high development activity. On the other hand, the coupler of the present invention provides an excellent graininess improving effect and sharpness improving effect even when used in a color reversal photographic material. This is because at the stage of the second development during color reversal processing, the compound released from the coupler acts as an agent to capture the oxidized developing agent, thereby consuming the oxidized developing agent. It is believed, therefore, that developable silver is consumed and finally coloration is inhibited, thus producing the DIR effect.

The group represented by RED in the general formula (I) can be any conventional scavenger compound known in the art, such as those described in T. H. James, *The Theory of the Photographic Process,* Chapter 11, Clause D (4th Ed., 1977) and *Angew. Chem. Int. Ed.,* 17, 875–886 (1978). Examples of the group are hydroquinones, 2- or 4-hydroxy-1-naphthols, 2- or 4-sulfonamidophenols, 2- or 4-sulfonamidonaphthols, 1,4-dihydroxybutadienes, 1,2-dihydroxyolefins, and their tautomers.

More preferred photographic couplers of the present invention are those represented by the following general formulae (II), (III) and (IV).

(II)

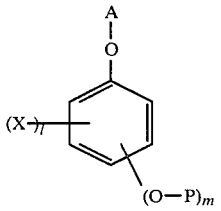

(III)

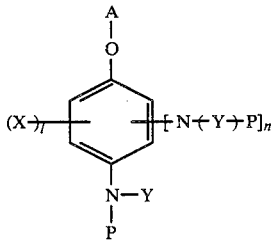

(IV)

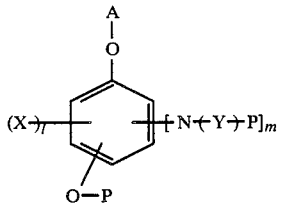

In the above general formulae, A and P are the same as defined in the general formula (I).

X is an aliphatic group, an aromatic group, a heterocyclic group, a halogen atom, an alkoxy group, an aryloxy group, an arylthio group, an alkoxycarbonyl group, a cyano group, a nitro group, a carbamoyl group, a sulfamoyl group, an acyloxy group, a heterocyclic thio group, an alkylthio group, a sulfonyl group, an aryloxycarbonyl group, an acyl group, or when l is 2,

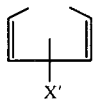

(wherein X′ is the same as X). When these substituents contain an aliphatic moiety, the number of carbon atoms is about 1 to 32 and preferably about 1 to 16, and it may be straight or branched, chain or cyclic, saturated or unsaturated, or substituted or unsubstituted. When X contains an aromatic moiety, the number of carbon atoms is about 6 to 10 and preferably it is a substituted or unsubstituted phenyl group. l is 0, 1, 2 or 3, and when l is 2 or more, X may represent the same substituent or different substituents.

P is a group capable of being decomposed by an alkali or other components contained in the developer. Known precursor groups can be used as P, including an acyl group, a carbamoyl group, precursor groups of the type that utilize the reverse Michel reaction, as described in U.S. Pat. No. 4,009,029, precursor groups of the type that utilize, after a ring cleavage reaction, a formed anion as an intramolecular nucleophilic group, as described in U.S. Pat. No. 4,310,612, precursor groups in which an anion transfers an electron through the conjugated system, thereby releasing a photographically useful group, as described in U.S. Pat. Nos. 3,674,478, 3,932,480 and 3,993,661, precursor groups utilizing an imidomethyl group, as described in Japanese Patent Application (OPI) No. 135949/82 (corresponding to U.S. Pat. No. 4,350,752), and precursor groups of the type that utilizes the electron transfer of an anion formed after the ring cleavage as described in U.S. Pat. No. 4,335,200.

P may be any group which is cleavable by an alkali or other additives contained in the developer. Preferably, it is —COR or —$SO_2R$, in which R is an aliphatic group, an aromatic group, or a heterocyclic group. When R is an aliphatic group, the number of carbon atoms is about 1 to 32 and preferably about 1 to 18, and it may be substituted or unsubstituted, straight or branched, chain or cyclic, or saturated or unsaturated. Substituents for R include a halogen atom, an aryl group, an alkoxy group, an aryloxy group, an arylthio group, an alkoxycarbonyl group, a hydroxy group, an acylamino group, a cyano group, a nitro group, a carbamoyl group, a sulfamoyl group, a sulfonamido group, an acyloxy group, an alkylthio group, an amino group, a sulfonyl group, an acyl group, a ureido group, and an aryloxycarbonyl group. When these substituents contain an aliphatic moiety, the number of carbon atoms is about 1 to 16, and it may be straight or branched, chain or cyclic, saturated or unsaturated, or substituted or unsubstituted. When the above substituents contain an aromatic moiety, the number of carbon atoms is about 6 to 10, and it is preferably a substituted or unsubstituted phenyl group.

When R represents an aromatic group, the number of carbon atoms is about 6 to 10, and it is preferably a substituted or unsubstituted phenyl group. Substituents of the aromatic group R include an aliphatic group, an aromatic group, a heterocyclic group, a halogen atom, an alkoxy group, an aryloxy group, an arylthio group, an alkoxycarbonyl group, a hydroxy group, an acylamino group, a cyano group, a nitro group, a carbamoyl group, a sulfamoyl group, a sulfonamido group, an acyloxy group, an alkylthio group, an amino group, a sulfonyl group, a ureido group, an aryloxycarbonyl group, a carboxy group, an acyl group, an alkoxycarbonylamino group, and a sulfamoylamino group. When these substituents contain an aliphatic moiety, the number of carbon atoms is about 1 to 32 and preferably about 1 to 16, and it may be straight or branched, chain or cyclic, saturated or unsaturated, or substituted or unsubstituted. When the above substituents contain an aromatic moiety, the number of carbon atoms is about 6 to 10, and preferably it is a substituted or unsubstituted phenyl group. When the above substituents contain a heterocyclic group, this group includes a ring structure of, e.g., indazole, pyrrole, thiophene, tetrahydrofuran, benzimidazole, pyridine, triazole, pyrazole and imidazolidine-2,4-dione.

When R represents a heterocyclic group, it is preferably a 5- to 7-membered heterocyclic group containing a nitrogen atom, a sulfur atom, an oxygen atom or a selenium atom as the hetero atom. Examples are imidazole, pyrazole, 1,2,4-triazole, thiophene, furan, benzimidazole, pyridine, and tetrahydrofuran. These groups may be further substituted. Preferred examples of the substituent are an aliphatic group, an aromatic group, an acylamino group, a sulfonamido group, an alkoxy group, a halogen atom, an aryloxycarbonyl group, an alkoxycarbonyl group, an alkylthio group, a ureido group, a cyano group, an amino group, and an aryloxy group. When these substituents contain an aliphatic moiety, the number of carbon atoms is about 1 to 32 and preferably about 1 to 16, and it may be straight or branched, chain or cyclic, saturated or unsaturated, or substituted or unsubstituted. When the above substituents contain an aromatic moiety, the number of carbon atoms is about 6 to 10 and preferably it is a substituted or unsubstituted phenyl group.

In the general formulae (III) and (IV), Y is a hydrogen atom, an aliphatic group, an aromatic group, a heterocyclic group (wherein each of these groups is the same as defined for the corresponding group represented by R), a group —COR, or a group —$SO_2R$, wherein R is defined as in the group P above.

In the general formula (II), m is 1 or 2, and -(O—P) is at the o- or p-position of the phenoxy group.

In the general formula (III), n is 0, 1 or 2.

In the general formula (VI), m is 1 or 2, and at least one of -(O—P) and -(N-(Y)-P] is at the o- or p-position of the phenoxy group. The substituent P of —O—P and the substituent P of —N-(Y)-P may be the same or different, or the same substituent P may be linked to the O and N atoms to form a ring (e.g., oxazole ring).

It is preferred in the present invention that in the general formula (I), A is any one of coupler residues represented by the following general formulae (V), (VI), (VII), (VIII), (IX) (X) (XI), (XII), (XIII), (XIV) and (XV). These couplers are preferred in that the coupling rate is high.

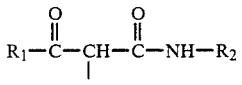
(V)

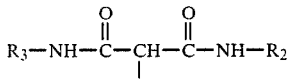
(VI)

-continued

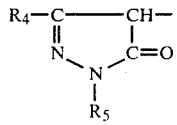
(VII)

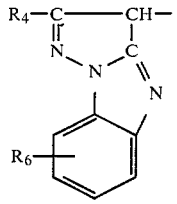
(VIII)

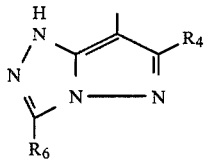
(IX)

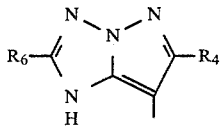
(X)

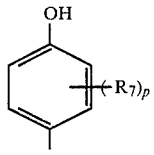
(XI)

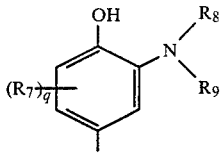
(XII)

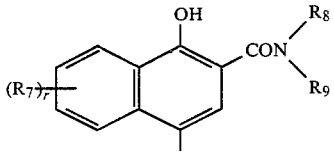
(XIII)

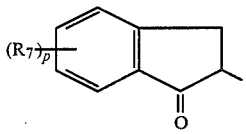
(XIV)

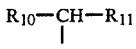
(XV)

In the above formulae, the free bond extending from the coupling position indicates the position at which the coupler A is bonded to RED. When $R_1$, $R_2$, $R_3$, $R_4$, $R_5$, $R_6$, $R_7$, $R_8$, $R_9$, $R_{10}$ or $R_{11}$ contains an antidiffusion group, it is chosen so that the combined number of carbon atoms of all R substituents in each formula is about 8 to 32 and preferably about 10 to 22. In other cases, the combined number of carbon atoms of all R substituents in each formula is preferably about 15 or less.

$R_1$ to $R_{11}$, p, q and r in the above general formulae (V) to (XV) are defined as follows.

$R_1$ is an aliphatic group, an aromatic group, an alkoxy group, or a heterocyclic group, and $R_2$ and $R_3$ are each an aromatic group or a heterocyclic group.

The aliphatic group represented by $R_1$ preferably has about 1 to 22 carbon atoms and may be substituted or unsubstituted, chain or cyclic. Preferred substituents for the aliphatic group are an alkoxy group, an aryloxy group, an amino group, an acylamino group, a halogen atom, which may be further substituted. Typical examples of the aliphatic group represented by $R_1$ are an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 1-methoxyisopropyl group, a 1-phenoxyisopropyl group, a 1-p-tert-butylphenoxyisopropyl group, an α-aminoisopropyl group, an α-(diethylamino)isopropyl group, an α-(succinimido)isopropyl group, an α-(phthalimido)isopropyl group, and an α-(benzenesulfonamido)isopropyl group.

When $R_1$, $R_2$ or $R_3$ represents an aromatic group (particularly a phenyl group), the aromatic group may be substituted. Aromatic groups such as a phenyl group may be substituted with groups having about 32 or fewer carbon atoms, such as an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, and an alkyl-substituted succinimido group. In these substituents, the alkyl moiety may contain an aromatic group such as phenylene in the chain thereof. The phenyl group represented by $R_1$, $R_2$ or $R_3$ may be substituted with an aryloxy group, an aryloxycarbonyl group, an arylcarbamoyl group, an arylamido group, an arylsulfamoyl group, an arylsulfonamido group, or an arylureido group. The aryl moiety of these substituents may be further substituted with one or more alkyl groups the total number of carbon atoms of which is about 1 to 22.

The phenyl group represented by $R_1$, $R_2$ or $R_3$ may be further substituted with an amino group (including an amino group substituted with a lower alkyl group having about 1 to 6 carbon atoms), a hydroxy group, a carboxy group, a sulfo group, a nitro group, a cyano group, a thiocyano group, or a halogen atom.

$R_1$, $R_2$ or $R_3$ may be a substituent containing a phenyl group condensed with another ring, such as a naphthyl group, a quinolyl group, an isoquinolyl group, a chromanyl group, a coumaranyl group, and a tetrahydronaphthyl group. These substituents themselves may be further substituted.

When $R_1$ represents an alkoxy group, the alkyl moiety has about 1 to 32, preferably about 1 to 22 carbon atoms and is a straight or branched alkyl group, an alkenyl group, a cyclic alkyl group, or a cyclic alkenyl group. These groups may be further substituted with, for example, a halogen atom, an aryl group or an alkoxy group.

When $R_1$, $R_2$ or $R_3$ is a heterocyclic group, the heterocyclic group is linked through one of the carbon atoms forming the ring to a carbon atom of the carbonyl group of the acyl group of or a nitrogen atom of the amido group of the α-acylacetamide. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine, and oxazine. These groups may further have a substituent in the ring thereof.

In the general formula (VII), $R_5$ is a straight or branched alkyl group having about 1 to 32 carbon atoms, preferably about 1 to 22 carbon atoms (e.g., a methyl group, an isopropyl group, a tert-butyl group, a hexyl group, and a dodecyl group), an alkenyl group (e.g., an allyl group), a cyclic alkyl group (e.g., a cyclopentyl group, a cyclohexyl group and a norbornyl group), an aralkyl group (e.g., a benzyl group and a β-phenylethyl group), or a cyclic alkenyl group (e.g., a cyclopentenyl group and a cyclohexenyl group). These groups may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group and a hydroxy group.

$R_5$ may further represent an aryl group (e.g., a phenyl group and an α- or β-naphthyl group). The aryl group may have one or more substituents. Examples of the substituent are an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group and a hydroxy group. $R_5$ is preferably a phenyl group which is substituted with, for example, an alkyl group, an alkoxy group, or a halogen atom in the o-position thereof. In this case, the coupler remaining in the film is colored only to a small extent by the action of light or heat.

$R_5$ may further be a heterocyclic group (5- or 6-membered heterocyclic ring containing a nitrogen atom, an oxygen atom or a sulfur atom as the hetero atom, or a condensed heterocyclic group, such as a pyridyl group, a quinolyl group, a furyl group, a benzothiazolyl group, an oxazolyl group, an imidazolyl group, and a naphthoxazolyl group), a heterocyclic group substituted with a substituent specified for the above aryl group represented by $R_5$, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_4$ is any of a hydrogen atom, a straight or branched alkyl group having about 1 to 32 carbon atoms, preferably about 1 to 22 carbon atoms, an alkenyl group, a cyclic alkyl group, an aralkyl group, a cyclic alkenyl group (each of which may be substituted with the substituents specified for the groups represented by $R_5$), an aryl group, a heterocyclic group (either of which may be substituted with the substituents specified for the groups represented by $R_5$), an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an α-naphthylthio group), a carboxy group, an acylamino group (e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group (e.g., a ureido group, an N-arylureido group, and an N-alkylureido group), a urethane group, a thiourethane group, an arylamino group (e.g., a phenylamino group, an N-methylanilino group, a diphenylamino group, an N-acetylanilino group and a 2-chloro-5-tetradecanamidoanilino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-pyridylamino group and a 2-benzoxazolylamino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group, an N-methylphenylcarbamoyl group and an N-phenylcarbamoyl group), a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group and a hydroxy group.

$R_6$ is a hydrogen atom, a straight or branched alkyl group having about 1 to 32 carbon atoms, preferably about 1 to 22 carbon atoms, an alkenyl group, a cyclic alkyl group, an aralkyl group or a cyclic alkenyl group. These groups may be further substituted with the substituents specified for the groups represented by $R_5$.

$R_6$ also may be an aryl group or a heterocyclic group, which may be substituted with the substituents specified for the groups represented by $R_5$.

$R_6$ may be a cyano group, an alkoxy group, an aryloxy group, a halogen atom, a carboxy group, an alkoxycarbonyl group, an aryloxycarbonyl group, an acyloxy group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group or a hydroxy group.

$R_7$, $R_8$ and $R_9$ each represents a conventional group present in the typical 4-equivalent phenol or α-naphthol coupler. In more detail, $R_7$ is a hydrogen atom, a halogen atom, an alkoxycarbonylamino group, an aliphatic hydrocarbon residue, an N-arylureido group, an acylamino group, a group —O—$R_{12}$, or a group —S—$R_{12}$ (wherein $R_{12}$ is an aliphatic hydrocarbon residue). When two or more of $R_7$ are present in the same molecule, the groups may be the same or different. The aliphatic hydrocarbon residue includes those containing a substituent or substituents.

When these substituents contains an aryl group, the aryl group may be substituted with the substituents specified for the groups represented by $R_5$.

$R_8$ and $R_9$ may be aliphatic hydrocarbon residues, aryl groups, or heterocyclic residues. One of $R_8$ and $R_9$ may be a hydrogen atom. The above groups may be further substituted. $R_8$ and $R_9$ may combine to form a nitrogen-containing heterocyclic nucleus.

The aliphatic hydrocarbon residue may be saturated or unsaturated, straight, branched or cyclic. Preferred examples of the aliphatic hydrocarbon residue are an alkyl group (e.g., a methyl group, an ethyl group, a propyl group, an isopropyl group, a butyl group, a tert-butyl group, an isobutyl group, a dodecyl group, an octadecyl group, a cyclobutyl group and a cyclohexyl group), and an alkenyl group (e.g., an allyl group and an octenyl group). Examples of the aryl group are a phenyl group and a naphthyl group. Typical examples of the heterocyclic residue are a pyridinyl group, a quinolyl group, a thienyl group, a piperidyl group and an imidazolyl group. These aliphatic hydrocarbon residue, aryl group and heterocyclic residue may be substituted with substituents which include a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an acylamino group, a carbamoyl group, an ester group, an acyl group, an acyloxy group, a sulfonamido group, a sulfamoyl group, a sulfonyl group, and a morpholino group.

p is an integer of 1 to 3, q is an integer of 1 or 2, and r is an integer of 1 to 4.

$R_{10}$ is an arylcarbonyl group, an alkanoyl group having about 2 to 32 carbon atoms, preferably about 2 to 22 carbon atoms, an arylcarbamoyl group, an alkanecarbamoyl group having about 2 to 32 carbon atoms, preferably about 2 to 22 carbon atoms, an alkoxycarbonyl group having about 1 to 32 carbon atoms, preferably about 1 to 22 carbon atoms, or an aryloxycarbonyl group. These groups may be further substituted. Examples of such substituents include an alkoxy group, an alkoxycarbonyl group, an acylamino group, an alkylsulfamoyl group, an alkylsulfonamido group, an alkylsuccinimido group, a halogen atom, a nitro group, a carboxy group, a nitrile group, an alkyl group or an aryl group.

$R_{11}$ is an arylcarbonyl group, an alkanoyl group having about 2 to 32 carbon atoms, preferably about 2 to 22 carbon atoms, an arylcarbamoyl group, an alkanecarbamoyl group having about 2 to 32 carbon atoms, preferably about 2 to 22 carbon atoms, an alkoxycarbonyl or aryloxycarbonyl group having about 1 to 32 carbon atoms, preferably about 1 to 22 carbon atoms, an alkanesulfonyl group having about 1 to 32 carbon atoms, preferably about 1 to 22 carbon atoms, an arylsulfonyl group, an aryl group, or a 5- or 6-membered heterocyclic group containing a nitrogen atom, an oxygen atom or a sulfur atom as the hetero atom (e.g., a triazolyl group, an imidazolyl group, a phthalimido group, a succinimido group, a furyl group, a pyridyl group or a benzotriazolyl group). These groups may be substituted with the substituents specified for the groups represented by $R_{10}$.

Typical examples of the compounds which can be used in the present invention are shown below, although the present invention is not limited thereto.
(1)
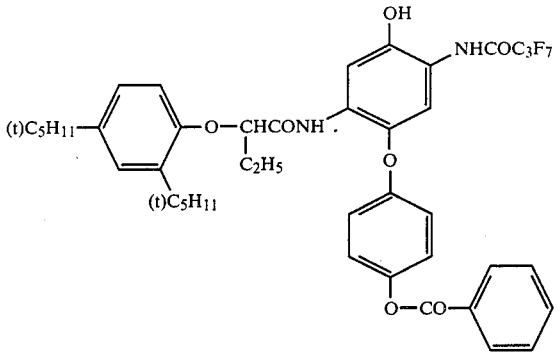
(2)
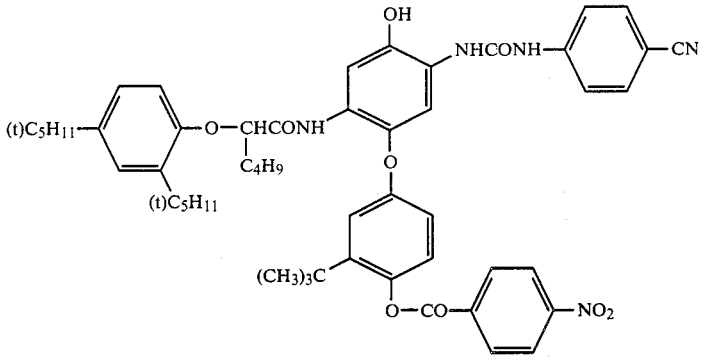
(3)
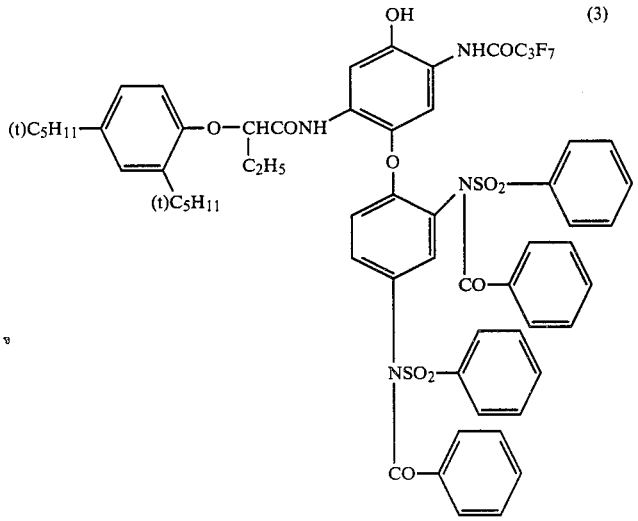
(4)
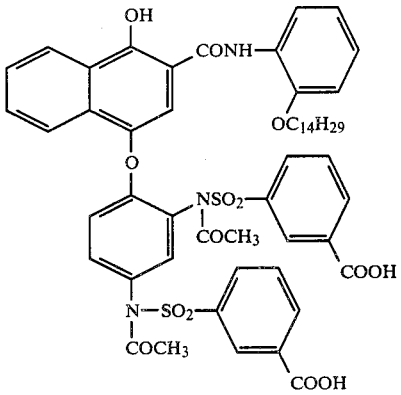

-continued
(5)
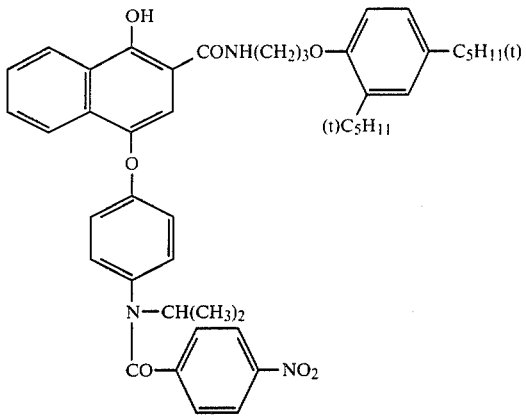
(6)
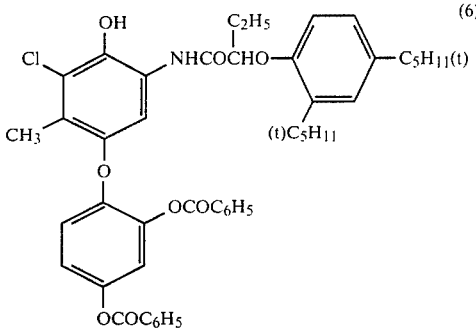
(7)
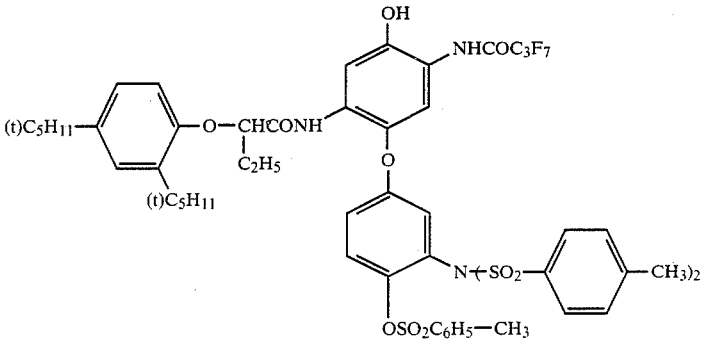
(8)
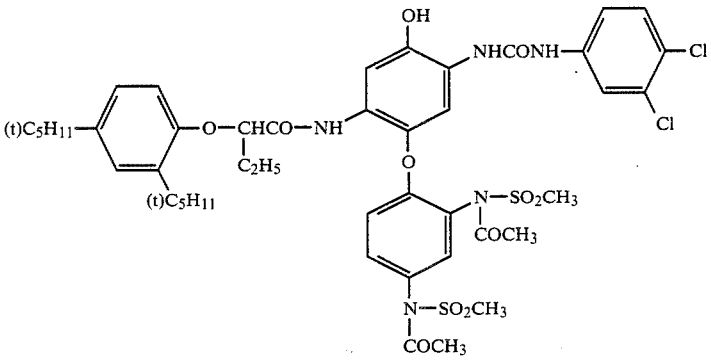
(9)
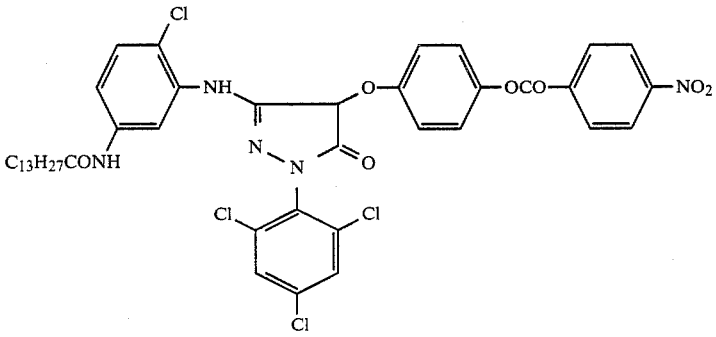

-continued
(10)
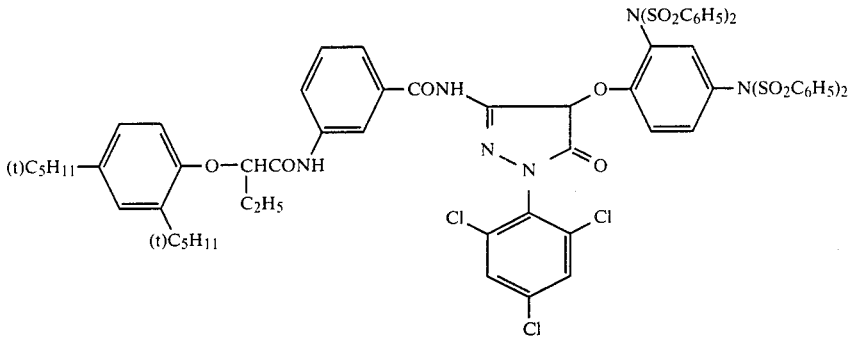
(11)
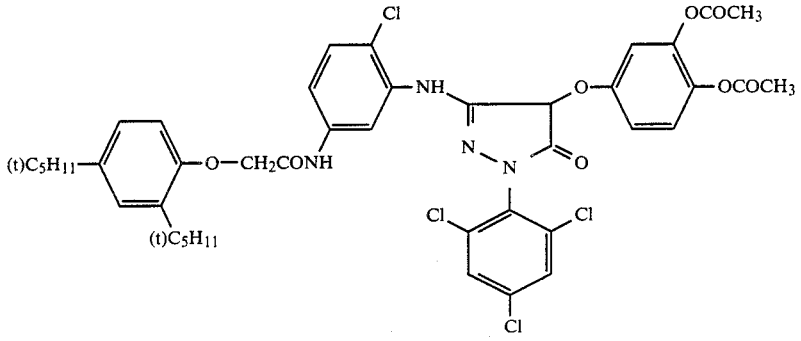
(12)
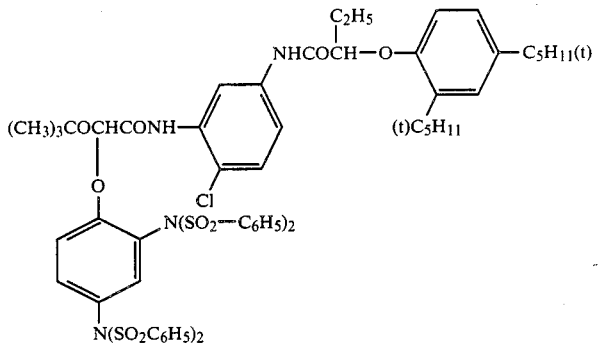
(13)
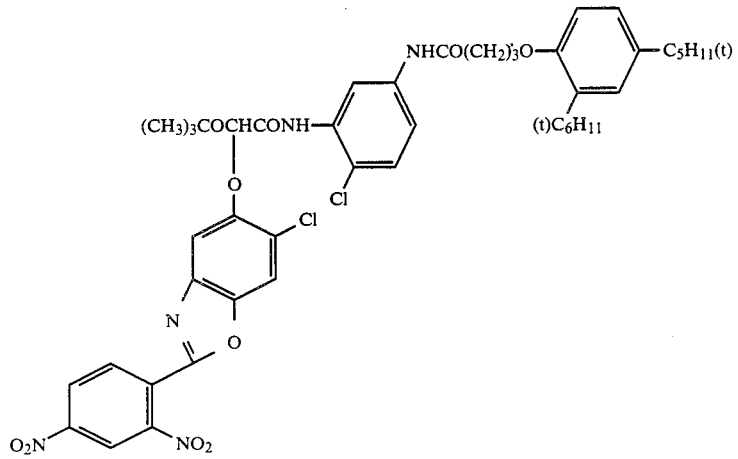

-continued
(14)
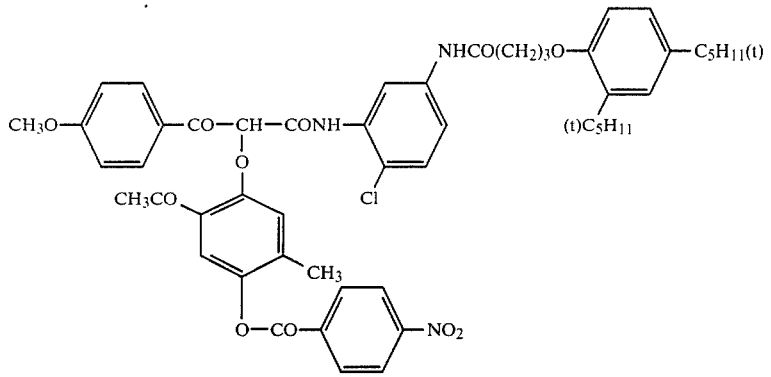
(15)
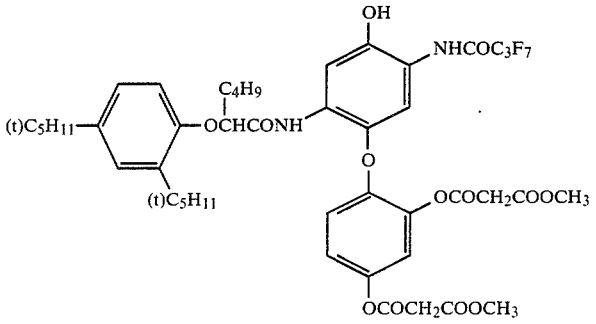
(16)
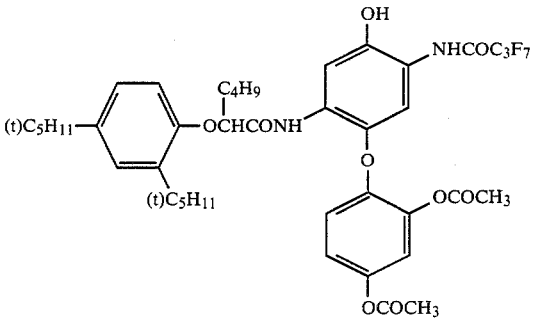
(17)
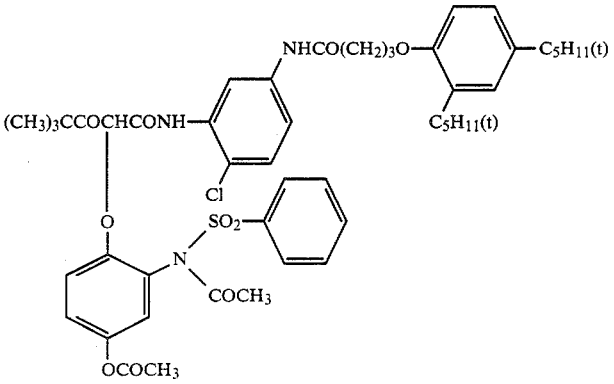

-continued
(18)
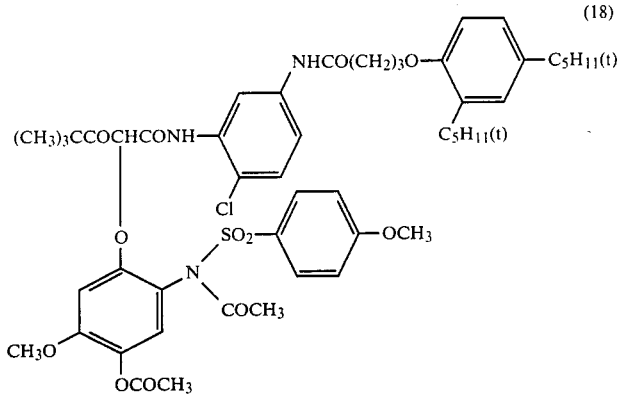
(19)
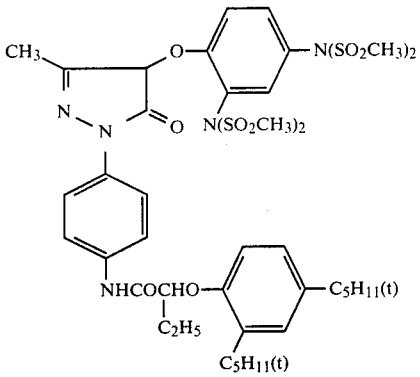
(20)
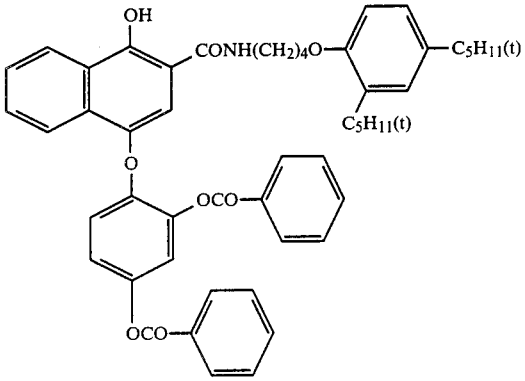
(21)
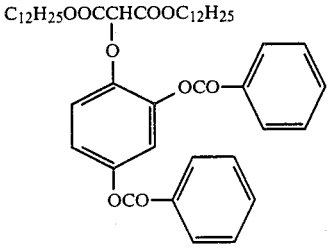
(22)
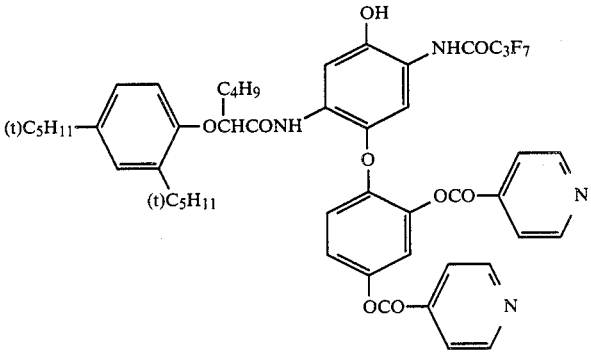
(23)
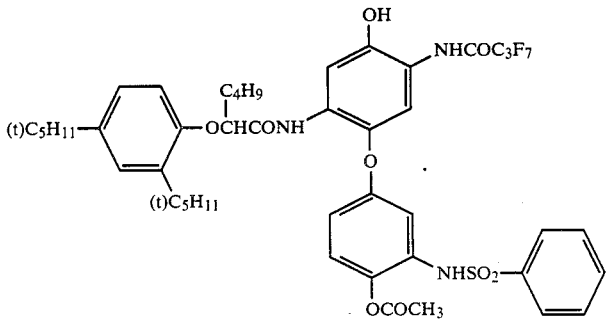

-continued
(24)
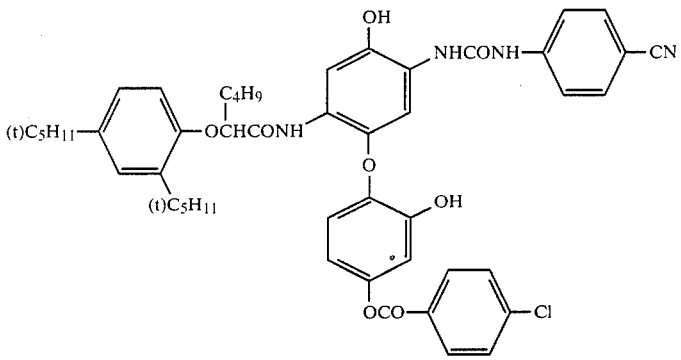
(25)
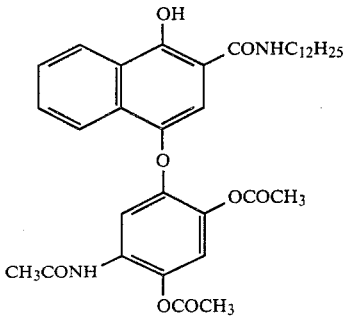
(26)
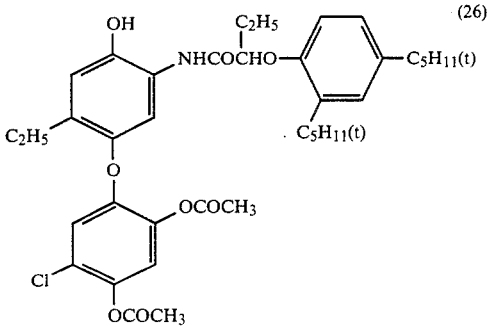
PREPARATION EXAMPLE 1
Preparation of Compound (1)
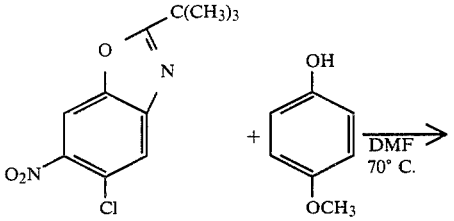
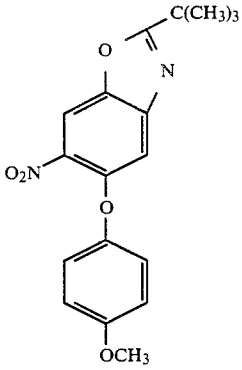
-continued
PREPARATION EXAMPLE 1
Preparation of Compound (1)
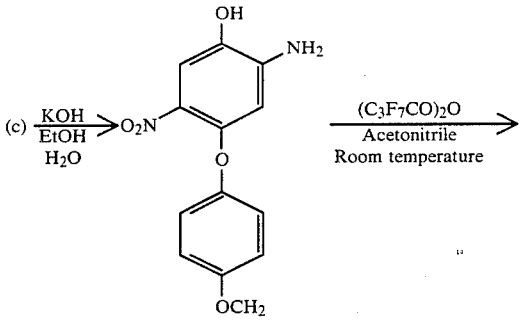
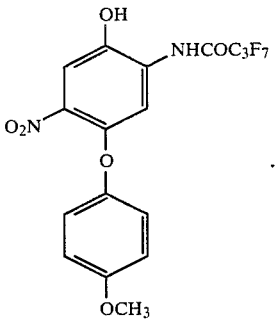

-continued

PREPARATION EXAMPLE 1

Preparation of Compound (1)

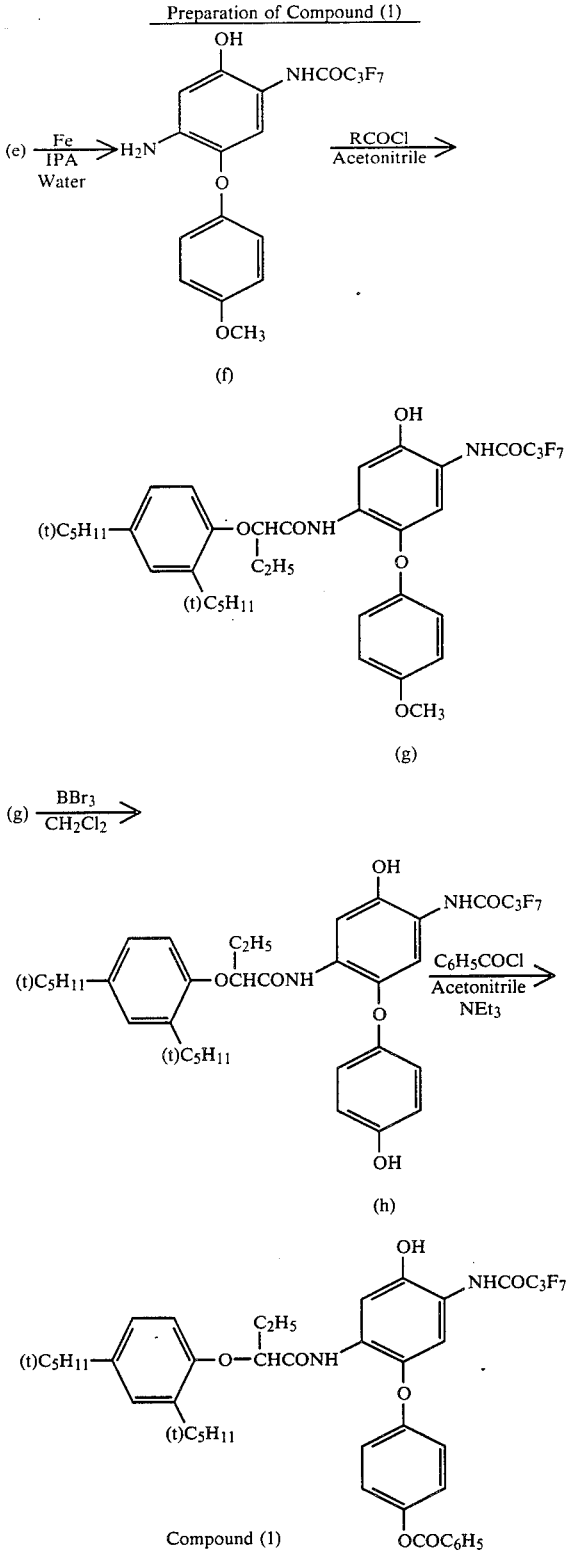

Step (1): Preparation of Compound (c)

A mixture of 186 g of p-methoxyphenol and 99 g of potassium hydroxide was refluxed for 3 hours with toluene as a solvent. After water and the toluene were distilled away, 275 g of Compound (a) and 500 ml of dimethylformamide were added and reacted at 70° C. for 3 hours.

Then, 500 ml of methanol was gradually added to the reaction solution, and crystals precipitated were collected by filtration to obtain 185 g of Compound (c).

Step (2): Preparation of Compound (d)

Compound (c) (185 g) was dissolved in a mixed solvent of 600 ml of ethanol and 200 ml of water, and 135 g of potassium hydroxide was added thereto. The resulting mixture was refluxed for 3 hours. Then, the mixture was neutralized with diluted hydrochloric acid, and crystals precipitated were collected by filtration to obtain 136 g of Compound (d).

Step (3): Preparation of Compound (e)

Compound (d) (136 g) was mixed with 1,000 ml of acetonitrile, and 230 g of anhydrous perfluorobutanoic acid was added dropwise to the mixture at room temperature. The resulting mixture was stirred for 1 hour. Then, water was gradually added to the reaction solution, and crystals precipitated were collected by filtration. These crystals were recrystallized from a hexane/ethyl acetate mixed solvent to yield 203 g of Compound (e).

Step (4): Preparation of Compound (f)

A mixture of 120 g of reduced iron, 7 g of ammonium chloride, 7 ml of acetic acid, 80 ml of water, and 600 ml of isopropyl alcohol was refluxed for 5 minutes.

Then, 100 g of Compound (e) was gradually added under reflux. After 30 minutes, the reaction solution was filtered, and the filtrate was concentrated. The crude crystals thus obtained were recrystallized from a diethyl ether/hexane mixed solvent to yield 84 g of Compound (f).

Step (5): Preparation of Compound (g)

Compound (f) (84 g) was dissolved in 500 ml of acetonitrile, and 64 g of α-(2,4-di-tert-amyl)phenoxybutanoyl chloride forming a ballast was added dropwise under reflux. The mixture was further refluxed for 30 minutes. Then, the reaction solution was cooled with ice, and crystals precipitated were collected by filtration to yield 118 g of Compound (g).

Step (6): Preparation of Compound (h)

Compound (g) (50 g) was dissolved in 800 ml of dichloromethane and then cooled to 0° C. Then, 50.5 g of boron tribromide was added while maintaining the temperature at 0° C. The reaction mixture was further stirred for 2 hours. Then, water was gradually added dropwise to the reaction solution, and crystals precipitated were collected by filtration. These crystals were decolorized by treating with active carbon and then recrystallized from a diethyl ether/hexane mixed solvent to yield 25.4 g of Compound (h), m.p.: 202.5°–204.0° C.

Step (7): Preparation of Compound (1)

Compound (h) (20 g) was dissolved in 100 ml of acetonitrile, and 4.0 g of benzoyl chloride was added dropwise at room temperature. Then, 2.8 g of triethylamine was added dropwise. The resulting mixture was stirred for 2 hours. Then, the reaction solution was extracted with ethyl acetate and washed with water, and then the solvent was distilled away. The crude crystals thus obtained were passed through a column packed with a silica gel as a filler, using an ethyl acetate/n-hexane mixed solvent as an eluting solution to separate the desired product. This compound was concentrated and then recrystallized from a diethyl ether/n-hexane mixed solvent to yield 11.4 g of Compound (1).

PREPARATION EXAMPLE 2

Preparation of Compound (2)

Compound (2) was prepared in the same manner as in Preparation Example 1 except that in step (1), 3-tert-butyl-p-methoxyphenol was used in place of p-methoxyphenol; in step (3), p-cyanophenyl isocyanate was used in place of anhydrous perfluorobutanoic acid; and in step (7), p-nitrobenzoyl was used in place of benzoyl chloride.

One of ordinary skill in the art will readily appreciate that other couplers according to the present invention can be synthesized by making appropriate modifications and substitutions in the above synthesis methods.

Although not desiring to be bound by theory, it is believed that in the coupler of the present invention, when a photographic material containing the coupler is treated with a developer, (RED-P) is cleaved from A, the (RED-P) portion thus formed is diffused into an alkaline aqueous solution from the dispersion oil and, as a result, its decomposition is accelerated to thereby release RED.

The coupler of the present invention is preferably used in a silver halide emulsion layer or the adjacent layers thereof and it is preferably used in combination with conventional photographic color coupler. The coupler of the present invention is used in an amount (a molar ratio of the coupler of the present invention/the conventional photographic color coupler) of, preferably 5/95 to 100/0, more preferably 10/90 to 60/40.

The coupler of the present invention and couplers which can be used in combination with the coupler of the present invention, as described hereinafter can be incorporated in the photographic material by known dispersion techniques such as the solid dispersion method and the alkali dispersion method, preferably the latex dispersion method, and more preferably the oil-in-water dispersion method. In the oil-in-water dispersion method, the coupler is dissolved in a high boiling organic solvent having a boiling point of at least about 175° C. and/or an auxiliary solvent having a low boiling point and then the resulting solution is finely dispersed in an aqueous medium such as water and an aqueous gelatin solution in the presence of a surface active agent. Typical examples of the high boiling organic solvent are described in, for example, U.S. Pat. No. 2,322,027. This dispersion may be accompanied by phase inversion. The dispersion may be applied, if desired, after removing the auxiliary solvent or decreasing its amount by techniques such as distillation, the noodle washing method, or the ultrafiltration method.

Typical examples of the high boiling organic solvent include, e.g., phthalic acid esters (e.g., dibutyl phthalate, dicyclohexyl phthalate, di-2-ethylhexyl phthalate, and didodecyl phthalate), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic acid esters (e.g., 2-ethylhexyl benzoate, dodecyl benzoate, and 2-ethylhexyl-p-hydroxy benzoate), amides (e.g., diethyldodecanamide, and N-tetradecylpyrrolidone), alcohols or phenols (e.g., isostearyl alcohol and 2,4-di-tert-amylphenol), aliphatic carboxylic acid esters (e.g., dioctyl azelate, glycerol tributylate, isostearyl lactate and trioctyl citrate), aniline derivatives (e.g., N,N-dibutyl-2-butoxy-5-tert-octylaniline), and hydrocarbons (e.g., paraffin, dodecylbenzene and diisopropylnaphthalene). As the auxiliary solvents, those having a boiling point of about 30° to 160° C. can be used. Typical examples of the auxiliary solvent include, e.g., ethyl acetate, butyl acetate, ethyl propionate, methyl ethyl ketone, cyclohexanone, 2-ethoxyethyl acetate, and dimethylformamide.

Steps and effects of the latex dispersion method, and typical examples of the latex used for impregnation are described in U.S. Pat. No. 4,199,363 and West German Patent Application (OLS) Nos. 2,541,274 and 2,541,230.

Various color couplers can be used in the present invention. The term "color coupler" as used herein means a compound capable of forming a dye on reacting with the oxidized product of an aromatic primary amine developing agent. Examples of useful color couplers are naphthol- or phenol-based compounds, pyrazolone- or pyrazoloazole-based compounds, and open chain or heterocyclic ketomethylene compounds. Typical examples of cyan, magenta and yellow couplers which can be used in the present invention are described in the patents described in *Research Disclosure* (RD), 17643, Clause VII-D (December, 1978) and 18717 (November, 1979).

It is preferred for the color coupler incorporated in the photographic material to be rendered non-diffusible by having a ballast group or being polymerized. 2-Equivalent color couplers in which the coupling active position is substituted with a releasing group are preferably over 4-equivlent color couplers in which the coupling active position is a hydrogen atom. Couplers in which the color forming dye possesses suitable diffusibility, colorless couplers, or DIR couplers releasing a development inhibitor with the progress of the coupling reaction, or couplers releasing a development accelerator with the progress of the coupling reaction can also be used in the present invention.

Typical examples of the yellow coupler that can be used in the present invention are acylacetamide-based couplers. Representative examples are described in, for example, U.S. Pat. Nos. 2,407,210, 2,875,057 and 3,265,506. 2-Equivalent yellow couplers are preferably used in the present invention. Typical examples are oxygen atom releasing type yellow couplers as described in, for example, U.S. Pat. Nos. 3,408,194, 3,447,928, 3,933,501 and 4,022,620, and nitrogen atom releasing type yellow couplers as described in, for example, Japanese Patent Publication No. 10739/83, U.S. Pat. Nos. 4,401,752, 4,326,024, *Research Disclosure* (*RD*), 18053 (April, 1979), British Pat. No. 1,425,020, West German Patent Application (OLS) Nos. 2,219,917, 2,261,361, 2,329,587 and 2,433,812. α-Pivaloylacetanilide-based couplers produce colored dyes having particularly excellent light fastness, and α-benzoylacetanilide-based couplers produce colored dyes having a high color density.

Magenta couplers which can be used in the present invention include indazolone- or cyanoacetyl-based couplers. Preferred examples are pyrazoloazole-based couplers such as 5-pyrazolone-based couplers and pyrazolotriazoles. As the 5-pyrazolone-based coupler, those couplers which are substituted with an arylamino or acylamino group in the 3-position are preferred in respect of the hue and color density of the colored dye. Typical examples are described in U.S. Pat. Nos. 2,311,082, 2,343,703, 2,600,788, 2,908,573, 3,062,653, 3,152,896 and 3,936,015. 2-Equivalent 5-pyrazolone-based couplers are preferred in that they provide a high color density and high sensitivity even when a coating amount of silver is small. Particularly preferred examples of the releasing group are a nitrogen atom releasing group as described in U.S. Pat. No. 4,310,619 and an arylthio group as described in U.S. Pat. No. 4,351,897. The ballast group described in European Pat. No. 73,636 increases the color density even for 5-pyrazolone-based couplers. The pyrazoloazole-based coupler includes pyrazolobenzimidazoles as described in U.S. Pat. No. 3,369,897. Preferred examples are pyrazolo[5,1-c][1,2,4]triazoles as described in U.S. Pat. No. 3,725,067, pyrazolotetrazoles as described in *Research Disclosure* (*RD*), 24220 (June, 1984), and pyrazolopyrazoles as described in *Research Disclosure* (*RD*), 24230 (June, 1984). From the viewpoint of the decreased yellow sub-absorption and light fastness of colored dye, imidazo[1,2-b]pyrazoles as described in European Pat. No. 119,741 are preferred. Particularly preferred are pyrazolo[1,5-b][1,2,4]triazoles as described in European Pat. No. 119,860.

Cyan couplers which can be used in the present invention include naphthol-based and phenol-based couplers. Typical examples are naphthol-based couplers as described in U.S. Pat. No. 2,474,293, preferably oxygen atom releasing type 2-equivalent naphthol-based couplers as described in U.S. Pat. Nos. 4,052,212, 4,146,396, 4,228,233 and 4,296,200. Representative examples of the phenol-based coupler are described in, for example, U.S. Pat. Nos. 2,369,929, 2,801,171, 2,772,162 and 2,895,826. Cyan couplers which are fast to humidity and temperature are preferably used in the present invention. Typical examples of such cyan couplers are phenol-based cyan couplers as described in U.S. Pat. No. 3,772,002, 2,5-diacylamino-substituted phenol-based couplers as described in U.S. Pat. Nos. 2,772,162, 3,758,308, 4,126,396, 4,334,011, 4,327,173, West German Patent Application (OLS) No. 3,329,729, and Japanese Patent Application No. 42671/83 (corresponding to Japanese Patent Application (OPI) No. 166956/84), and phenol-based couplers having a phenylureido group in the 2-position and an acylamino group in the 5-position as described in, for example, U.S. Pat. Nos. 3,446,622, 4,333,999, 4,451,559 and 4,427,767.

The amount of the dye forming coupler added is about 0.002 to 0.5 mol per mol of light-sensitive silver halide in a layer in which the coupler is to be incorporated. In a color photographic material for photography using a camera, the amounts of the yellow coupler, magenta coupler and cyan coupler used are typically about 0.01 to 0.5 mol, 0.003 to 0.25 mol and 0.002 to 0.12 mol, respectively, each being per mol of light-sensitive silver halide. In a color photographic material for prints, such as a color paper, each of the yellow, magenta and cyan couplers is typically used in an amount of about 0.1 to 0.5 mol per mol of light-sensitive silver halide, although outside this range, a photographic material can be produced, if desired.

In order to satisfy the characteristics required for the photographic material, two or more of the couplers of the present invention and of the above described couplers can be added to the same layer, or the same coupler can be added to two or more layers.

In a color photographic material for use in cameras, to correct the undesirable absorption in a shorter wavelength region of magenta and cyan couplers, it is preferred to use a colored coupler in combination with a dye forming coupler and a coupler according to the present invention. Typical examples of such colored couplers are yellow colored magenta couplers as described in U.S. Pat. No. 4,163,670 and Japanese Patent Publication No. 39413/82, and magenta colored cyan couplers as described in U.S. Pat. Nos. 4,004,929, 4,138,258 and British Pat. No. 1,146,368.

These colored couplers may form a dimer or other polymer. Typical examples of such polymerized couplers are described in U.S. Pat. Nos. 3,451,820 and 4,080,211. Typical examples of polymerized magenta couplers are described in British Pat. No. 2,102,173 and U.S. Pat. No. 4,367,282.

In photographic materials according to the present invention, graininess can be improved by using color forming dye diffusion type couplers. Representative examples of such magenta couplers are described in U.S. Pat. No. 4,366,237, and British Pat. No. 2,125,570, and representative examples of yellow, magenta and cyan couplers are described in European Pat. No. 96,873 and West German Patent Application (OLS) No. 3,324,533.

As a binder of protective colloid used in an emulsion layer and an intermediate layer or other of the photographic material of the present invention, it is advantageous to use gelatin. Other conventional hydrophilic colloids can also be used alone or in combination with gelatin.

Any of silver bromide, silver iodobromide, silver iodochlorobromide, silver chlorobromide and silver chloride can be used as the silver halide in a photographic emulsion layer of the photographic material of the present invention. A preferred example is silver iodobromide containing about 15 mol% or less of silver iodide. Particularly preferred is silver iodobromide containing about 2 to 12 mol% of silver iodide.

Silver halide grains used in the photographic emulsion of the present invention may have a regular crystal form (e.g., cubic, octahedral, dodecahedral and tetradecahedral), or an irregular crystal form (e.g., spherical) or a composite crystal form. In addition, an emulsion in which tabular silver halide grains having a thickness of about 0.5 micron or less, a diameter of at least about 0.6 micron, and an average aspect ratio of at least about 5 constitute 50% or more of the total projected area can be used.

The crystal structure may be uniform in composition throughout the grain or may differ in composition between the core and the outer layer. A layer structure may be used, or a structure in which silver halides having different compositions are epitaxially bonded together may be used. In addition, a mixture of grains having various crystal forms can be employed.

The silver halide grains may be such that a latent image is formed mainly on the surface of the grain, or such that a latent image is formed mainly in the interior thereof.

The particle size of the silver halide used may be as small as about 0.1 micron or less or as large as about 3 microns (as a projected area diameter). A monodispersion emulsion having a narrow distribution of grain sizes, or a multidispersion emulsion having a broad distribution may be used.

The photographic emulsion that is used in the present invention can be prepared by, for example, the methods described in P. Glafkides, *Chimie et Physique Photographique,* pages 329–425 (Paul Montel Co., 1967), G. F. Duffin, *Photographic Emulsion Chemistry,* pages 57 to 82 (The Focal Press Co., Ltd., 1966), and V. L. Zelikman et al., *Making and Coating Photographic Emulsion,* pages 69–87 (The Focal Press Co., Ltd., 1964). For example, any of the acidic method, the neutral method and the ammonia method can be employed. A soluble silver salt and a soluble halogen salt can be reacted by any of the single jet method, the double jet method, a combination thereof, and so forth.

A so-called reversal mixing method in which silver halide particles are formed in the presence of an excess of silver ions can be employed. As one embodiment of the double jet method, a "controlled double jet" method can be employed in which the pAg of a liquid phase where silver halide is formed is maintained constant. In accordance with this method, a silver halide emulsion can be obtained in which the crystal form is regular and the particle size is nearly uniform.

Two or more silver halide emulsions which have been prepared separately may be used as a mixture.

In the process of formation or physical ripening of silver halide particles, a cadmium salt, a zinc salt, a lead salt, a thallium salt, an iridium salt or its complex salt, a rhodium salt or its complex salt, an iron salt or its complex salts, or the like may be present.

The silver halide emulsion is usually chemically sensitized. This chemical sensitization can be carried out by, for example, the methods described in H. Frieser ed., *Die Grundlagen der Photographischen Prozesse mit Silberhalogeniden,* pages 675–734 (Akademische Verlagsgesellschaft, 1968).

For example, the sulfur sensitization method using sulfur-containing compounds capable of reacting with active gelatin or silver, such as thiosulfuric acid salts, thioureas, mercapto compounds, and rhodanines; the reduction sensitization method using reducing substances such as stannic salts, amines, hydrazine derivatives, formamidine-sulfinic acid, and silane compounds; and the noble metal sensitization method using noble metal compounds such as gold complex salts, and complex salts of Group VIII metals (e.g., platinum, iridium and palladium) can be used alone or in combination with each other.

Various compounds can be incorporated in the photographic emulsion of the present invention for the purpose of preventing the formation of fog during the process of production, storage or photographic processing of the photographic material, or of stabilizing photographic performance. That is, many conventional antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles, particularly 1-phenyl-5-mercaptotetrazole); mercaptopyrimidines; mercaptotriazines; thioketo compounds (e.g., oxazolidonethione); azaindenes (e.g., triazaindenes, tetraazaindenes, particularly 4-hydroxy-substituted (1,3,3a,7)tetraazaindenes and pentaazaindenes); benzenesulfonic acid; benzenesulfinic acid; and benzenesulfonic acid amides can be added.

For the purpose of increasing sensitivity or contrast, or accelerating development, polyalkylene oxide or its derivatives (e.g., ethers, esters and amines), thioether compounds, thiomorpholines, quaternary ammonium salts, urethane derivatives, urea derivatives, imidazole derivatives, 3-pyrazolidones, and the like can be incorporated in the photographic emulsion layer of the photographic material of the present invention.

For the purpose of, for example, improving dimensional stability, dispersions of water-insoluble or sparingly water-soluble synthetic polymers can be incorporated in the photographic emulsion layer or other hydrophilic colloidal layer of the photographic material of the present invention.

The photographic emulsion that is used in the present invention may be subjected to spectral sensitization using conventional methine dyes and so forth. Dyes which can be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to the cyanine dyes, merocyanine dyes, and complex merocyanine dyes. These dyes can contain any conventional nuclei used as basic heterocyclic nuclei in cyanine dyes.

These sensitizing dyes can be used alone or in combination with each other. Such combinations of sensitizing dyes are often used for the purpose of supersensitization.

In combination with these sensitizing dyes, dyes not having a spectral sensitization action by themselves but exhibiting supersensitization or substances not substantially absorbing visible light but exhibiting supersensitization may be incorporated in the emulsion. For example, aminostyryl compounds substituted with a nitrogen-containing heterocyclic group (e.g., those compounds described in U.S. Pat. Nos. 2,933,390 and 3,635,721), aromatic organic acid/formaldehyde condensates (e.g., compounds described in U.S. Pat. No. 3,743,510), cadmium salts, and azaindene compounds may be incorporated.

The present invention can be applied to a multilayer polychromatic photographic material comprising a support having thereon at least two layers each having different spectral sensitivity. Such multilayer natural color photographic mterials usually have at least one red-sensitive emulsion layer, at least one green-sensitive emulsion layer and at least one blue-sensitive emulsion layer on a support. The order in which the above layers are coated is not critical and can be determined according to use. Usually the red-sensitive emulsion layer contains a cyan forming coupler, the green-sensitive emulsion layer contains a magenta forming coupler, and the blue-sensitive emulsion layer contains a yellow forming coupler, however, if desired, other combinations can be employed.

In the photographic material of the present invention, inorganic or organic hardening agents may be incorporated in the photographic emulsion layer and other hydrophilic colloid layers. For example, active vinyl compounds (e.g., 1,3,5-triacryloyl-hexahydro-s-triazine, and 1,3-vinylsulfonyl-2-propanol), active halogeno compounds (e.g., 2,4-dichloro-6-hydroxy-s-triazine), mucohalogenic acids (e.g., mucochloric acid, and mucophenoxychloric acid), and the like can be used alone or in combination with each other.

The photographic material of the present invention may further contain, as anti-color-foggants, hydroquinone derivatives, aminophenol derivatives, gallic acid derivatives, ascorbic acid derivatives, and so forth.

The photographic material of the present invention may contain ultraviolet absorbers in the hydrophilic colloid layer. Typical examples of ultraviolet absorbers which can be used include benzotriazoles substituted with an aryl group, described in U.S. Pat. Nos. 3,533,794, 4,236,013, Japanese Patent Publication No. 6540/76, and European Pat. No. 57,160; butadienes described in U.S. Pat. Nos. 4,045,229 and 4,195,999; cinnamic acid esters described in U.S. Pat. Nos. 3,705,805 and 3,707,375; benzophenones described in U.S. Pat. No. 3,215,530 and British Pat. No. 1,321,355; and polymeric compounds having an ultraviolet light absorbing residue described in U.S. Pat. Nos. 3,761,272 and 4,431,726. Ultraviolet light absorbing brightening agents described in U.S. Pat. Nos. 3,499,762 and 3,700,455 may be used. Typical examples of such ultraviolet absorbers are described in, for example, *Research Disclosure* (*RD*), 24239 (June, 1984).

In the photographic material of the present invention, water-soluble dyes may be incorporated in the hydrophilic colloid layer as filter dyes or for various purposes such as for the prevention of irradiation. These water-soluble dyes include oxonol dyes, hemioxonol dyes, styryl dyes, merocyanine dyes, cyanine dyes and azo dyes. Of these dyes, oxonol dyes, hemioxonol dyes and merocyanine dyes are useful.

In the practice of the present invention, known antifading agents can be used in combination. In addition, the antifading agents can be used alone or in combination with each other. The above known antifading agents include hydroquinone derivatives, gallic acid derivatives, p-alkoxyphenols, p-oxyphenol derivatives and bisphenols.

The color photographic emulsion layer for forming a dye image is coated on a flexible support, such as a plastic film, paper, or cloth, commonly used for photographic materials. Useful examples of such flexible supports are films of semisynthetic or synthetic polymers such as cellulose acetate, cellulose actate butyrate, polystyrene, polyethylene terephthalate, and polycarbonate, and paper coated or laminated with a baryta layer or $\alpha$-olefin polymers such as polyethylene and polypropylene. The support may be colored with dyes or pigments. Also, it may be colored black for the purpose of shielding the emulsion from light.

When the support is used as a reflection material, it is preferred that a white pigment be added to the support or a laminated layer. White pigments which can be used for this purpose include titanium dioxide, barium sulfate, zinc oxide, zinc sulfide, calcium carbonate, antimony trioxide, silica white, alumina white and titanium phosphate. Of these compounds, titanium dioxide, barium sulfate and zinc oxide are particularly useful.

The surface of the support is usually subjected to a subbing treatment to imrpove its adhesion to the photograhic emulsion, for example. Before or after this subbing treatment, the surface of the support may be subjected to treatments such as corona discharge, irradiation with ultraviolet rays, and flame treatment.

When the support is used as a reflection material, a hydrophilic colloid layer containing a high density of white pigment can be further provided between the support and the emulsion layer to thereby increase the whiteness and the sharpness of photographic image.

In a reflection material containing a magenta coupler which is used in the present invention, a polymer-laminated paper support is often used as the support. Synthetic resin films with a white pigment incorporated therein are particularly preferred in that they increase smoothness, gloss and sharpness, and further produce a photographic image particularly excellent in saturation and the drawing of dark areas. In this case, particularly useful examples of the synthetic resins are polyethylene terephthalate and cellulose acetate, and particularly useful examples of the white pigment are barium sulfate and titanium oxide.

If necessary, various photographic additives known in the field of photography, such as a stabilizer, an antifoggant, a surface active agent, an antistatic agent, and a developing agent, can be added to the photographic material of the present invention. Typical examples of such additives are described in *Research Disclosure,* 17643 (December, 1978).

In some cases, an emulsion containing finely divided silver halide particles (e.g., a silver chloride emulsion, a silver bromide emulsion and a silver chlorobromide emulsion in all of which the average particle size is about 0.20 $\mu$m or less), which substantially lacks light sensitivity, may be added to the silver halide emulsion layer or other hydrophilic colloid layers.

Preferred examples of the color developer that can be used in processing photographic materials according to the present invention are alkaline aqueous solutions composed mainly of aromatic primary amine-based color developing agents. Typical examples of such color developing agents are 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, and 4-amino-3-methyl-N-ethyl-N-$\beta$-methoxyethylaniline.

The color developer can contain a pH buffer (e.g., the sulfites, carbonates, borates, and phosphates of alkali metals), a development inhibitor (e.g., bromides, iodides, and organic antifoggants), and an antifoggant. If necessary, a hard water softening agent, a preservative (e.g., hydroxylamine), an organic solvent (e.g., benzyl alcohol and ethylene glycol), a development accelerator (e.g., polyethylene glycol, quaternary ammonium salts and amines), a dye forming coupler, a competing coupler, a fogging agent (e.g., sodium boron hydride), an auxiliary developing agent (e.g., 1-phenyl-3-pyrazolidone), a tackifier, a polycarboxylic acid-based chelating agent as described in U.S. Pat. No. 4,083,723, and an antioxidant as described in West German Patent Application (OLS) No. 2,622,950.

After color development, the photographic emulsion layer is usually bleached. This bleach treatment may be performed separately or simultaneously with a fixing treatment. Bleaching agents which can be used include compounds of polyvalent metals such as iron (III), cobalt (III), chromium (VI), and copper (II), peracids, quinones, and nitroso compounds. For example, ferricyanides, perchromates, organic complex salts of iron (III) or cobalt (III), such as complex salts of aminopolycarboxylic acids (e.g., ethylenediaminetetraacetic acid, nitrilotriacetic acid and 1,3-diamino-2-propanoltetraacetic acid) and organic acids (e.g., citric acid, tartaric acid and malic acid), persulfates, manganates, and nitrosophenol can be used. Of these compounds, potassium ferricyanide, sodium ethylenediaminetetraacetato ferrate, and ammonium ethylene-diaminetetraacetato ferrate are particularly useful. Ethylenediaminetetraacetic acid iron (III) complex salts are useful in both the independent bleaching solution and the combined bleach-fixing solution.

After color development or bleach-fixation, a water washing step may be used. Color development is carried out at any desired temperature chosen in the range of about 18° to 55° C. Preferably, it is carried out at temperatures of about 30° or more, and more preferably it is carried out at temperatures of about 35° C. The developing time is preferably short, i.e., within the range of about 1 to 3.5 minutes. In continuous development, it is preferred to replenish the developing solution. The developing solution is replenished in an amount of about 330 ml or less, preferably about 100 ml or less per square meter of the area to be processed. The concentration of benzyl alcohol in the developer is about 20 ml/l and preferably about 10 ml/l. Bleach-fixation can be carried out at any desired temperature between about 18° C. and 50° C. Preferably it is carried out at temperatures of about 30° C. or more. If the temperature is more than about 35° C., the processing time can be shortened to about 1 minute or less, and the amount of the developer replenished can be decreased. The time for washing with water after the color development or bleach-fixation is usually less than about 3 minutes. This washing time can be shortened to about 1 minute or less using a stabilization treatment.

Degradation of the formed dye image is caused not only by light, heat or temperature, but also by fungi during storage. The cyan dye is markedly degraded particularly by fungi. For this reason, it is preferred to use an antifungal agent. Typical examples of the antifungal agent are 2-thiazolylbenzimidazoles as described in Japanese Patent Application (OPI) No. 157244/82. The antifungal agent may be incorporated in the photographic material, or added from a processing solution during the process of development. If the antifungal agent is present in the processed photographic material, it can be added at any desired step.

The present invention can be applied to general silver halide color photographic materials such as a color negative film, a color paper, a color positive film, a color reversal film for slides, a color reversal film for movies, and a color reversal film for TV. In particular, when the present invention is applied to a color negative film or a color reversal film for which high sensitivity and high image quality are required, the sharpness and graininess are greatly improved.

The present invention can be applied to a photographic material utilizing a black coloration coupler system and a three color coupler mixing system. Details of the black coloration coupler are described in U.S. Pat. Nos. 3,622,629, 3,734,735, 4,126,461, Japanese Patent Application (OPI) Nos. 105247/80, 42725/77 and 105248/80. The three color coupler mixing system is described in detail in *Research Disclosure,* 17123 (July, 1978).

The present invention is described below in greater detail with reference to the following examples, although the present invention is not to be construed as being limited thereto. Unless otherwise indicated, all parts, percents and ratios are by weight.

EXAMPLE 1

The following emulsion and auxiliary layers were coated on a cellulose triacetate support with a subbing layer in the order shown below to produce a photographic material (Sample 1).

First Layer: Low Speed Red-Sensitive Emulsion Layer

In a mixture of 100 ml of tricresyl phosphate and 100 ml of ethyl acetate was dissolved 100 g of 2-(heptafluorobutyramido)-5-[2'-(2'',4''-di-tert-amylphenoxy)-butyramido]phenol (Coupler (1)) as a cyan coupler, and 1 kg of a 10% aqueous gelatin solution and 10 g of sodium dodecylbenzenesulfonate were added. The resulting mixture was stirred at a high speed to prepare an emulsion.

The emulsion thus prepared (500 g) was mixed with 1 kg of a low speed red-sensitive silver iodobromide emulsion (average particle size of silver halide particles: 0.3 μm; containing 70 g of silver and 60 g of gelatin; iodide content: 3 mol%), and further with gelatin, water, a stabilizer and a coating aid. The resulting mixture was coated in a dry thickness of 2 μm (amount of silver: 0.6 g/m$^2$).

Second Layer: Intermediate Speed Red-Sensitive Emulsion Layer

To 1 kg of the same cyan coupler emulsion as used in the preparation of the first layer were added 1 kg of an intermediate speed red-sensitive silver iodobromide emulsion (average particle size of silver halide particles: 0.5 μm; containing 70 g of silver and 60 g of gelatin; iodide content: 3 mol%), gelatin, water, a stabilizer and a coating aid. The resulting mixture was coated in a dry thickness of 1 μm (amount of silver: 0.4 g/m$^2$).

Third Layer: High Speed Red-Sensitive Emulsion Layer

To 1 kg of the same coupler emulsion as used in the preparation of the first layer were added 1 kg of a high speed red-sensitive silver iodobromide emulsion (average particle size of silver halide particles: 0.6 μm; containing 70 g of silver and 60 g of gelatin; iodide content: 3 mol%), gelatin, water, a stabilizer and a coating aid. The resulting mixture was coated in a dry thickness of 1 μm (amount of silver: 0.4 g/m$^2$).

Fourth Layer: Intermediate Layer

In 200 ml of ethyl acetate was dissolved 200 g of 2,5-di-sec-octylhydroquinone, and 1 kg of a 10% aqueous gelatin solution and 20 g of sodium dodecylbenzenesulfonate were added thereto. The resulting mixture was stirred at a high speed to prepare an emulsion. This emulsion was mixed with gelatin, water and a coating aid, and then coated in a dry thickness of 1 μm.

Fifth Layer: Low Speed Green-Sensitive Emulsion Layer

An emulsion was prepared in the same manner as in the preparation of the first layer except that 1-(2,4,6-trichlorophenyl)-3-[3-(2,4-di-tert-amylphenoxyacetamido)benzamido]-5-pyrazolone as a magenta coupler was used.

The emulsion thus prepared (500 g) was mixed with 1 kg of a low speed green-sensitive silver iodobromide emulsion (average particle size: 0.3 μm; containing 70 g of silver and 60 g of gelatin; iodide content: 3 mol%, gelatin, water, a stabilizer and a coating aid, and then coated in a dry thickness of 2 μm (amount of silver: 0.7 g/m$^2$).

Sixth Layer: Intermediate Speed Green-Sensitive Emulsion Layer

The same magenta coupler emulsion as used in the preparation of the fifth layer (1 kg) was mixed with 1 kg of an intermediate speed green-sensitive silver iodobromide emulsion (average particle size: 0.5 μm; containing 70 g of silver and 60 g of gelatin; iodide content: 3 mol%) and further with gelatin, water, a stabilizer, and a coating aid, and then coated in a dry thickness of 1 μm (amount of silver: 0.4 g/m$^2$).

Seventh Layer: High Speed Green-Sensitive Emulsion Layer

The same magenta coupler emulsion as used in the preparation of the fifth layer (1 kg) was mixed with 1 kg of a high speed green-sensitive silver iodobromide emulsion (average particle size: 0.7 μm; containing 70 g of silver and 60 g of gelatin; iodide content: 3 mol%) and further with gelatin, water, a stabilizer and a coating aid, and then coated in a dry thickness of 1 μm (amount of silver coated: 0.4 g/m$^2$).

Eighth Layer: Intermediate Layer

The same emulsion as used in the preparation of the fourth layer (1 kg) was mixed with gelatin, water and a coating aid, and then coated in a dry thickness of 0.5 μm.

Ninth Layer: Yellow Filter Layer

Yellow colloidal silver and gelatin were mixed and then coated in a dry thickness of 1 μm.

Tenth Layer: Low Speed Blue-Sensitive Emulsion Layer

An emulsion was prepared in the same manner as in the preparation of the first layer except that α-(pivaloyl)-α-(1-benzyl-5-ethoxy-3-hydantoinyl)-2-chloro-5-dodecyloxycarbonylacetanilide as a yellow coupler was used in place of the cyan coupler, and the amounts of tricresyl phosphate and ethyl acetate added were changed to 120 ml and 120 ml, respectively. The emulsion thus prepared (1 kg) was mixed with 1 kg of a low speed blue-sensitive silver iodobromide emulsion (average particle size: 0.5 μm; containing 70 g of silver and 60 g of gelatin; iodide content: 3 mol%) and further with gelatin, water, a stabilizer and a coating aid, and then coated in a dry thickness of 2 μm (amount of silver coated: 0.6 g/m$^2$).

Eleventh Layer: Intermediate Speed Blue-Sensitive Emulsion Layer

The same yellow coupler emulsion as used in the preparation of the tenth layer (1 kg) was mixed with 1 kg of an intermediate speed blue-sensitive silver iodobromide emulsion (average particle size: 0.6 μm; containing 70 g of silver and 60 g of gelatin; iodide content: 3 mol%) and further with gelatin, water, a stabilizer and a coating aid, and then coated in a dry thickness of 1 μm (amount of silver coated: 0.4 g/m$^2$).

Twelfth Layer: High Speed Blue-Sensitive Emulsion Layer

The same yellow coupler emulsion as used in the preparation of the tenth layer (1 kg) was mixed with 1 kg of a high speed blue-sensitive silver iodobromide emulsion (average particle size: 0.7 μm; containing 70 g of silver and 60 g of gelatin; iodide content: 3 mol%) and further with gelatin, water, a stabilizer and a coating aid, and then coated in a dry thickness of 1 μm (amount of silver coated: 0.4 g/m$^2$).

Thirteenth Layer: Second Protective Layer

A mixture of 15 g of 5-chloro-2-(2-hydroxy-3,5-di-tert-butylphenyl)-2H-benzotriazole, 30 g of 2-(2-hydroxy-5-tert-butylphenyl)-2H-benzotriazole, 35 g of 2-(2-hydroxy-3-sec-butyl-5-butylphenyl)-2H-benzotriazole, and 100 g of dodecyl-5-(N,N-diethylamino)-2-benzenesulfonyl-2,4-pentadienoate as ultraviolet absorbers (UV absorbers) was dissolved in a mixed solvent of 200 ml of tricresyl phosphate and 200 ml of ethyl acetate, and 20 g of sodium dodecylbenzenesulfonate and 2 kg of a 10% aqueous gelatin solution were added thereto. The resulting mixture was stirred at a high speed to prepare an emulsion. The emulsion thus prepared (1 kg) was mixed with gelatin, water and a coating aid, and then coated in a dry thickness of 2 μm (total amount of the UV absorbers coated: 0.5 g/m$^2$).

Fourteenth Layer: First Protective Layer

A finely divided silver iodobromide emulsion (particle size: 0.1 μm; containing 70 g of silver and 60 g of gelatin; iodide content: 1 mol%) which was not chemically sensitized was mixed with gelatin, water, a stabilizer and a coating aid, and then coated in a dry thickness of 1 μm (amount of silver: 0.3 g/m$^2$).

The multilayer film thus obtained is called Sample No. 1.

Multilayer films were prepared in the same manner as above except that in the preparation of the first to third layers, the emulsions were prepared using the combinations shown in the table below in place of Coupler (1). These films are designated Sample Nos. 2 to 12.

| Sample No. | Cyan Coupler Combination in First to Third Layers |
|---|---|
| 1 | Coupler (1) 100 g |
| 2 | Coupler (1) 50 g + Compound (1) 67.0 g |
| 3 | Coupler (1) 50 g + Compound (2) 73.2 g |
| 4 | Coupler (1) 50 g + Compound (3) 99.0 g |
| 5 | Coupler (1) 50 g + Compound (4) 84.3 g |
| 6 | Coupler (1) 50 g + Compound (5) 61.0 g |
| 7 | Coupler (1) 50 g + Compound (6) 63.6 g |
| 8 | Coupler (1) 50 g + Compound (7) 97.3 g |
| 9 | Coupler (1) 50 g + Comparative Compound (1) 65.5 g |
| 10 | Coupler (1) 50 g + Comparative Compound (2) 50.2 g |
| 11 | Coupler (1) 50 g + Comparative Compound (3) 58.3 g |
| 12 | Coupler (1) 50 g + Comparative Compound (4) 46.9 g |

Note: Molar ratio of Coupler (1) to Compound = 1:1

The chemical structures of comparative compounds are as follows.

Comparative Compound (1)

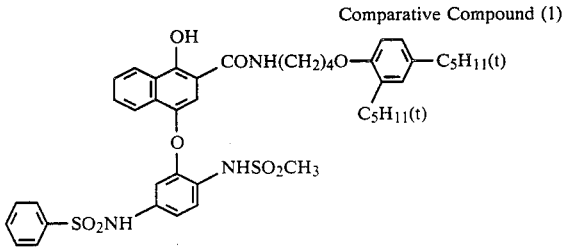

-continued

Comparative Compound (2)

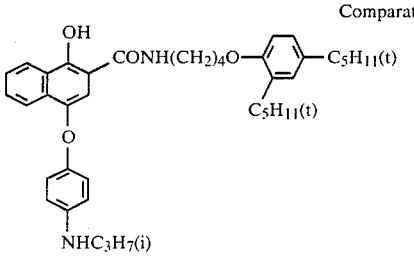

Comparative Compound (3)

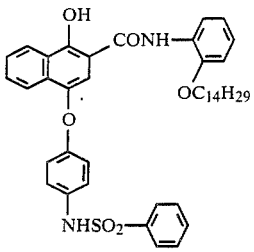

Comparative Compound (4)

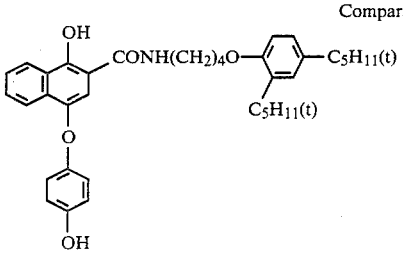

Sample Nos. 1 to 12 were each exposed to light through a pattern for the measurement of MTF and then subjected to a color reversal processing as described hereinafter. Thereafter, each sample was measured for the density by the use of a micro densitometer. The MTF value was determined by calculating from the above measured density.

The sharpness are shown in the table below as the MTF values at 10 lines/mm and 20 lines/mm.

| Sample No. | Sharpness MTF 10 lines/mm | Sharpness MTF 20 lines/mm |
|---|---|---|
| 1 (Comparison) | 0.78 | 0.57 |
| 2 (Present Invention) | 0.88 | 0.62 |
| 3 (Present Invention) | 0.91 | 0.65 |
| 4 (Present Invention) | 0.91 | 0.64 |
| 5 (Present Invention) | 0.93 | 0.67 |
| 6 (Present Invention) | 0.89 | 0.63 |
| 7 (Present Invention) | 0.90 | 0.65 |
| 8 (Present Invention) | 0.88 | 0.62 |
| 9 (Comparison) | 0.80 | 0.58 |
| 10 (Comparison) | 0.78 | 0.57 |
| 11 (Comparison) | 0.78 | 0.57 |
| 12 (Comparison) | 0.82 | 0.59 |

It can be seen from the above results that in Sample Nos. 2 to 8 in which the compounds of the present invention are used, the sharpness is greatly improved compared with Sample Nos. 1 and 9 to 12 (Comparative Examples).

| Step | Processing Steps Time (minutes) | Processing Steps Temperature (°C.) |
|---|---|---|
| First Development | 6 | 38 ± 0.3 |
| Washing with Water | 2 | " |
| Reversal | 2 | " |
| Color Development | 6 | " |
| Adjustment | 2 | " |
| Bleaching | 6 | " |
| Fixation | 4 | " |
| Washing with Water | 4 | " |
| Stabilization | 1 | Room Temperature |
| Drying | | |

The composition of the processing solution used in each step is shown below.

| | |
|---|---|
| **First Developer** | |
| Water | 700 ml |
| Sodium Tetrapolyphosphate | 2 g |
| Sodium Sulfite | 20 g |
| Hydroquinone · Monosulfonate | 30 g |
| Sodium Carbonate (monohydrate) | 30 g |
| 1-Phenyl-4-methyl-4-hydroxy-methyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| **Reversal** | |
| Water | 700 ml |
| Hexasodium Nitrilo-N,N,N—trimethylene-phosphate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| **Color Development** | |
| Water | 700 ml |
| Sodium Tetrapolyphosphate | 2 g |
| Sodium Sulfite | 7 g |
| Sodium Triphosphate (dihydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| **Adjustment** | |
| Water | 700 ml |
| Sodium Sulfite | 12 g |
| Sodium Ethylenediaminetetraacetate (dihydrate) | 8 g |
| Thioglycerin | 0.4 ml |
| Glacial Acetic Acid | 3 ml |
| Water to make | 1,000 ml |
| **Bleaching** | |
| Water | 800 ml |
| Sodium Ethylenediaminetetraacetate (dihydrate) | 2.0 g |
| Ammonium Ethylenediaminetetraacetato Ferrate (dihydrate) | 120.0 g |
| Potassium Bromide | 100.0 g |
| Water to make | 1,000 ml |
| **Fixation** | |
| Water | 800 ml |
| Ammonium Thiosulfate | 80.0 g |
| Sodium Sulfite | 5.0 g |
| Sodium Hydrosulfite | 5.0 g |
| Water to make | 1,000 ml |
| **Stabilization** | |
| Water | 800 ml |
| Formalin (37 wt %) | 5.0 ml |
| Surface Active Agent Solution (trade name: Driwel) | 5.0 ml |

-continued

| | |
|---|---|
| Water to make | 1,000 ml |

EXAMPLE 2

The following layers were coated on a transparent triacetyl cellulose film support in the order shown below to prepare a multilayer color photographic material (Sample 101).

| | |
|---|---|
| **First Layer: Antihalation Layer** | |
| Gelatin layer containing: | |
| Black colloid silver | 0.15 g/m$^2$ |
| Ultraviolet Absorber U-1 | 0.08 g/m$^2$ |
| Ultraviolet Absorber U-2 | 0.12 g/m$^2$ |
| **Second Layer: Intermediate Layer** | |
| Gelatin layer containing: | |
| 2,5-Di-tert-pentadecylhydroquinone | 0.18 g/m$^2$ |
| Coupler C-1 | 0.11 g/m$^2$ |
| **Third Layer: First Red-Sensitive Emulsion Layer** | |
| Gelatin layer containing: | |
| Silver iodobromide (silver iodide: 4 mol %; average particle size: 0.4 μm) | 1.2 g/m$^2$ |
| Sensitizing Dye I | 1.4 × 10$^{-4}$ mol per mol of silver |
| Sensitizing Dye II | 0.4 × 10$^{-4}$ mol per mol of silver |
| Sensitizing Dye III | 5.6 × 10$^{-4}$ mol per mol of silver |
| Sensitizing Dye IV | 4.0 × 10$^{-4}$ mol per mol of silver |
| Coupler C-2 | 0.45 g/m$^2$ |
| Coupler C-3 | 0.035 g/m$^2$ |
| Coupler C-4 | 0.025 g/m$^2$ |
| **Fourth Layer: Second Red-Sensitive Emulsion Layer** | |
| Gelatin layer containing: | |
| Silver iodobromide emulsion (silver iodide: 8 mol %; average particle size: 0.8 μm) | 1.0 g/m$^2$ |
| Sensitizing Dye I | 5.2 × 10$^{-5}$ mol per mol of silver |
| Sensitizing Dye II | 1.5 × 10$^{-5}$ mol per mol of silver |
| Sensitizing Dye III | 2.1 × 10$^{-4}$ mol per mol of silver |
| Sensitizing Dye IV | 1.5 × 10$^{-5}$ mol per mol of silver |
| Coupler C-2 | 0.050 g/m$^2$ |
| Coupler C-5 | 0.070 g/m$^2$ |
| Coupler C-3 | 0.035 g/m$^2$ |
| **Fifth Layer: Intermediate Layer** | |
| Gelatin layer containing: | |
| 2,5-Di-tert-pentadecylhydroquinone | 0.08 g/m$^2$ |
| **Sixth Layer: First Green-Sensitive Emulsion Layer** | |
| Gelatin layer containing: | |
| Silver iodobromide (silver iodide: 4 mol %; average particle size: 0.4 μm) | 0.80 g/m$^2$ |
| Sensitizing Dye V | 4.0 × 10$^{-4}$ mol per mol of silver |
| Sensitizing Dye VI | 3.0 × 10$^{-5}$ mol per mol of silver |
| Sensitizing Dye VII | 1.0 × 10$^{-4}$ mol per mol of silver |
| Coupler C-6 | 0.45 g/m$^2$ |
| Coupler C-7 | 0.13 g/m$^2$ |
| Coupler C-8 | 0.02 g/m$^2$ |
| Coupler C-4 | 0.04 g/m$^2$ |
| **Seventh Layer: Second Green-Sensitive Emulsion Layer** | |
| Gelatin layer containing: | |
| Silver iodobromide (silver iodide: 8 mol %; average particle size: 0.8 μm) | 0.85 g/m$^2$ |
| Sensitizing Dye V | 2.7 × 10$^{-4}$ mol per mol of silver |
| Sensitizing Dye VI | 1.8 × 10$^{-5}$ mol per mol of silver |
| Sensitizing Dye VII | 7.5 × 10$^{-5}$ mol per mol of silver |
| Coupler C-6 | 0.095 g/m$^2$ |
| Coupler C-7 | 0.015 g/m$^2$ |
| **Eighth Layer: Yellow Filter Layer** | |
| Gelatin layer containing: | |
| Yellow colloid silver | 0.08 g/m$^2$ |
| 2,5-Di-tert-pentadecylhydroquinone | 0.090 g/m$^2$ |
| **Ninth Layer: First Blue-Sensitive Emulsion Layer** | |
| Gelatin layer containing: | |
| Silver iodobromide emulsion (silver iodide: 5 mol %; average particle size: 0.3 μm) | 0.37 g/m$^2$ |
| Sensitizing Dye VIII | 4.4 × 10$^{-4}$ mol per mol of silver |
| Coupler C-9 | 0.71 g/m$^2$ |
| Coupler C-4 | 0.07 g/m$^2$ |
| **Tenth Layer: Second Blue-Sensitive Emulsion Layer** | |
| Gelatin layer containing: | |
| Silver iodobromide emulsion (silver iodide: 7 mol %; average particle size: 0.9 μm) | 0.55 g/m$^2$ |
| Sensitizing Dye VIII | 3.0 × 10$^{-4}$ mol per mol of silver |
| Coupler C-9 | 0.23 g/m$^2$ |
| **Eleventh Layer: First Protective Layer** | |
| Gelatin layer containing: | |
| Ultraviolet Absorber U-1 | 0.14 g/m$^2$ |
| Ultraviolet Absorber U-2 | 0.22 g/m$^2$ |
| **Twelfth Layer: Second Protective Layer** | |
| Gelatin layer containing: | |
| Silver iodobromide emulsion (silver iodide: 2 mol %; average particle size: 0.07 μm) | 0.25 g/m$^2$ |
| Polymethacrylate particles (diameter: 1.5 μm) | 0.10 g/m$^2$ |

In addition to the above ingredients, Gelatin Hardener H-1 and a surface active agent were added to each layer.

Color photographic materials were prepared in the same manner as above except that in the preparation of the third layer, 50 mol% of Coupler C-2 was replaced with 50 mol% of Coupler (20) or Coupler (25) of the present invention. These materials are called Sample 102 and Sample 103, respectively.

Each material was exposed through a red filter to light for sensitometry and then developed with a color developer as shown below. Also, the usual exposure for the measurement of RMS was applied and then the material was subjected to the same color development as above. The material was measured for photographic properties and graininess by the use of a red filter. An aperture in the measurement of graininess was 48 μm.

The development was performed at 38° C. according to the following scheme.

| | |
|---|---|
| 1. Color Development | 3.25 minutes |
| 2. Bleaching | 6.5 minutes |
| 3. Washing with Water | 3.25 minutes |
| 4. Fixation | 6.5 minutes |
| 5. Washing with Water | 3.25 minutes |
| 6. Stabilization | 3.25 minutes |

The composition of the solution used in each step was as follows.

| | |
|---|---|
| **Color Developer** | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1,000 ml |
| **Bleaching Solution** | |
| Ammonium Bromide | 160.0 g |
| Aqueous Ammonia (28%) | 25.0 ml |
| Sodium Ethylenediaminetetraacetato Ferrate | 130.0 g |
| Glacial Acetic Acid | 14.0 ml |
| Water to make | 1,000 ml |
| **Fixing Solution** | |

-continued

| | |
|---|---|
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1,000 ml |
| Stabilizing Solution | |
| Formalin | 8 ml |
| Water to make | 1,000 ml |

TABLE 1

| Sample No. | Fog | Relative Sensitivity of Red Image* | Graininess of Red Image** |
|---|---|---|---|
| 101 (Comparison) | 0.14 | 100 | 0.042 |

TABLE 1-continued

| Sample No. | Fog | Relative Sensitivity of Red Image* | Graininess of Red Image** |
|---|---|---|---|
| 102 (Present Invention) | 0.14 | 100 | 0.036 |
| 103 (Present Invention) | 0.14 | 99 | 0.033 |

Note:
*Relative sensitivity: Reciprocal of an exposure amount to provide fog of +0.2 and indicated as a relative value with that of Sample 101 as 100.
**Graininess: Value at a density of 0.8.

It can be seen from the results of Table 1 that Samples 102 and 103 of the present invention are excellent in graininess.

The chemical structures of the compounds used in Example 2 are shown below.

U-1

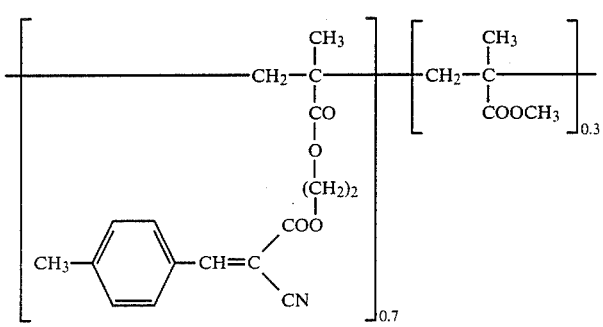

(molecular weight: about 20,000)

U-2

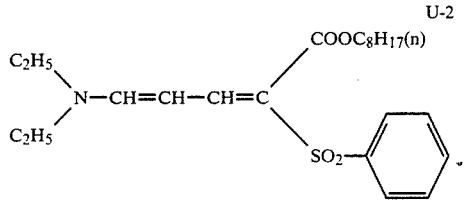

C-1

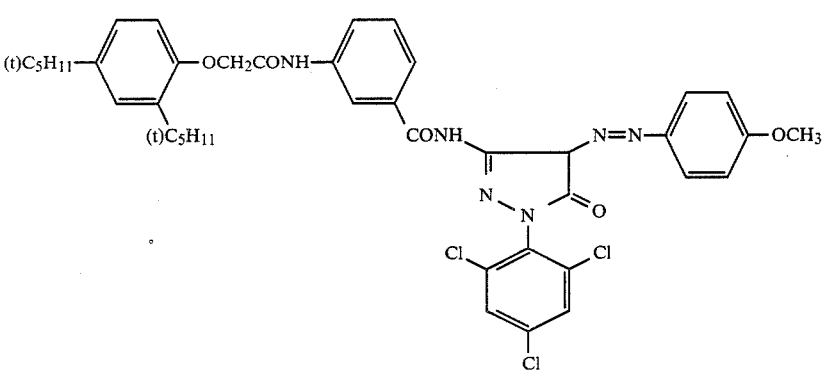

C-2

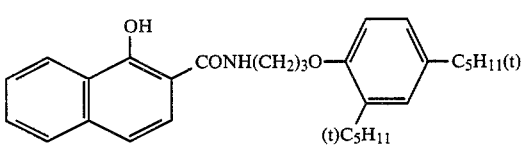

C-3

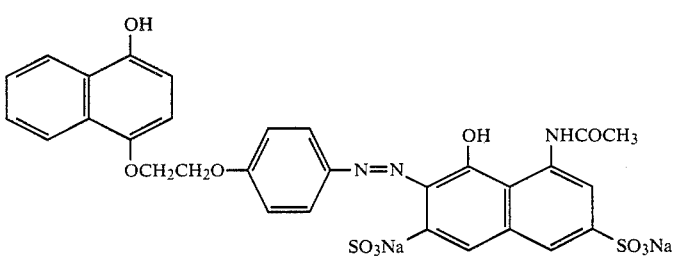

-continued
C-4
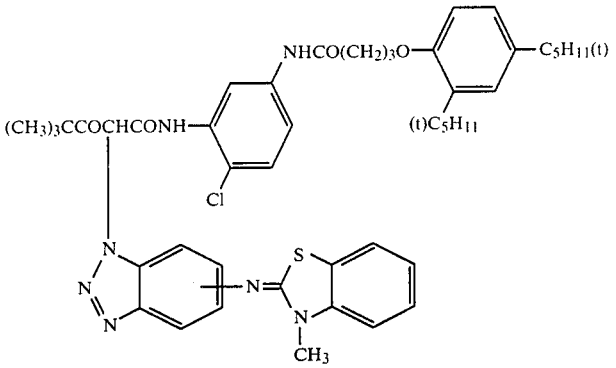
C-5
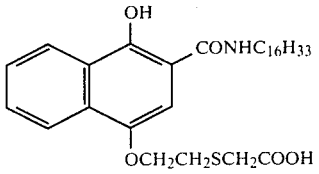
C-6
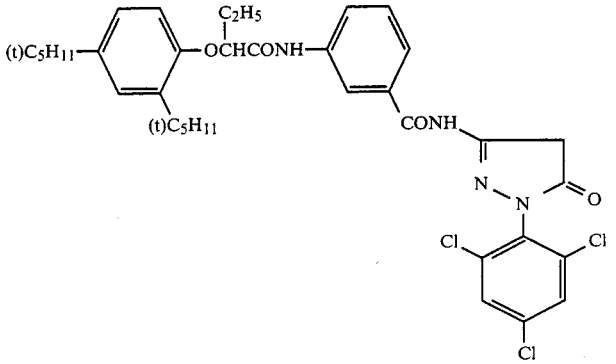
C-7
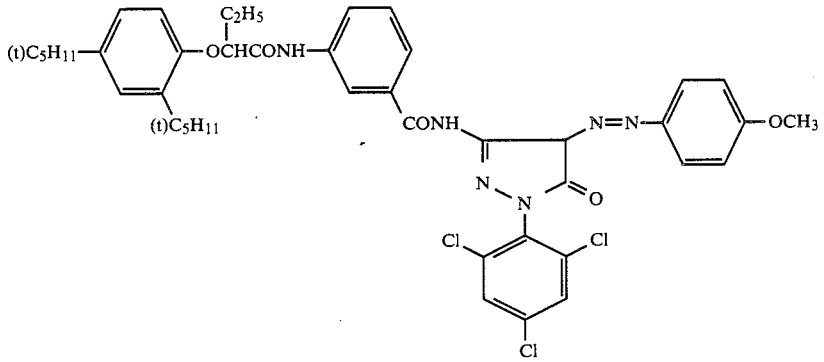
C-8
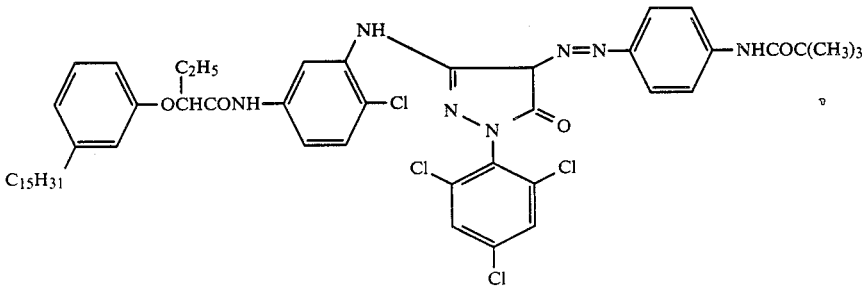

-continued

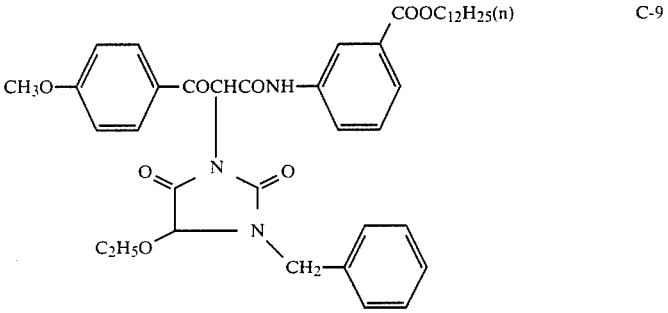

C-9

$CH_2{=}CH{-}SO_2{-}CH_2{-}CONH(CH_2)_2NHCO{-}CH_2{-}SO_2{-}CH{=}CH_2$ H-1

Sensitizing Dye I

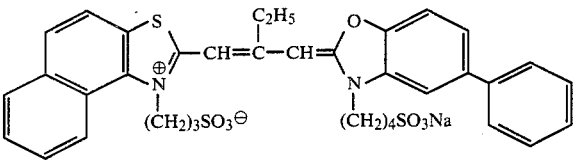

Sensitizing Dye II

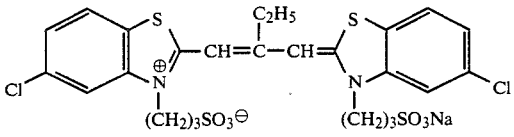

Sensitizing Dye III

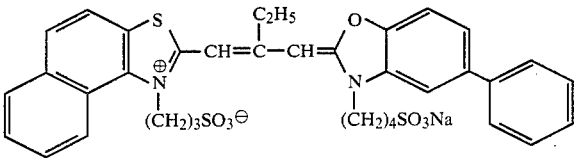

Sensitizing Dye IV

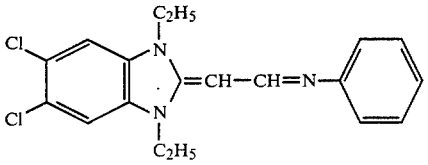

Sensitizing Dye V

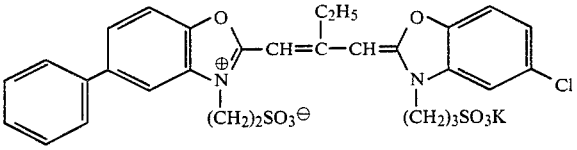

Sensitizing Dye VI

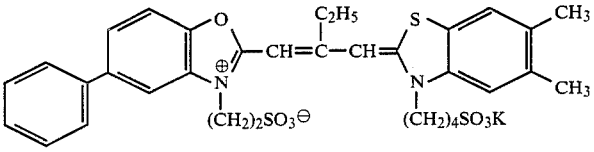

Sensitizing Dye VII

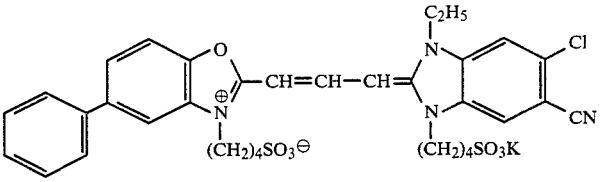

Sensitizing Dye VIII

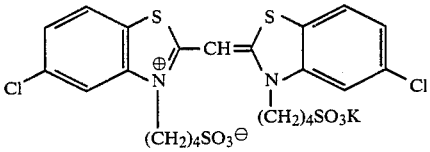

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least a light-sensitive silver halide and a coupler represented by the following general formula (I):

A-RED-P (I)

wherein A is a coupler residue capable of cleaving RED-P on reacting with an oxidized color developing agent, P is a group capable of releasing RED after cleavage of RED-P from A, and RED is a group capable of undergoing an oxidation reduction reaction with the oxidized color developing agent only after the cleavage of A and P, wherein said coupler represented by general formula (I) is represented by the following general formula (II), (III) or (IV):

(II)

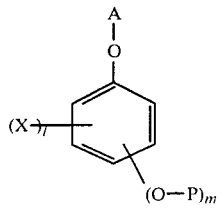

(III)

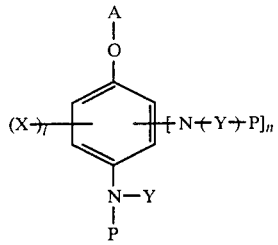

(IV)

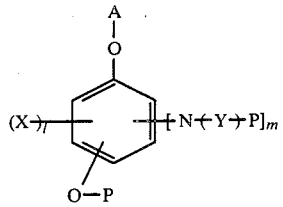

wherein A is the same as defined in the general formula (I);

l is 0, 1, 2 or 3;

X represents an aliphatic group, an aromatic group, a heterocyclic group, a halogen atom, an alkoxy group, an aryloxy group, an arylthio group, an alkoxycarbonyl group, a cyano group, a nitro group, a carbamoyl group, a sulfamoyl group, an acyloxy group, a heterocyclic thio group, an alkylthio group, a sulfonyl group, an aryloxycarbonyl group, an acyl group, or when l is 2, a group

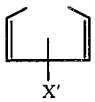

where X' has the same definition as X;

Y is a hydrogen atom, an aliphatic group, an aromatic group, or a heterocyclic group, a group —COR, or a group —$SO_2R$ wherein R represents an aliphatic group, an aromatic group or a heterocyclic group;

P is a group which is cleavable by an alkali or other additive contained in the developer;

m is 1 or 2;

n is 0, 1 or 2;

in general formula (II) the ⟨O—P) group is in the ortho- or para-position of the phenol group, and in general formula (IV) at least one of the ⟨O⟩P) group and the ⟨N⟨Y⟩P] group is at the ortho-position or para-position of the phenoxy group, provided that in formula (IV) the P moiety of the group —O—P and the group —N⟨Y⟩P are the same or different, and the substituent P may be linked to both the O and N atoms to form a ring.

2. The silver halide color photographic material as claimed in claim 1, wherein X in general formulae (II), (III) and (IV) represents an aliphatic group containing about 1 to 32 carbon atoms, an aromatic group containing about 6 to 10 carbon atoms, and P is —COR or —$SO_2R$, wherein R represents a substituted or unsubstituted aliphatic group having about 1 to 32 carbon atoms, a substituted or unsubstituted phenyl group, or a substituted or unsubstituted 5- to 7-membered heterocyclic group.

3. The silver halide color photographic material as claimed in claim 1, wherein A is represented by the following general formula (V) or (VI):

(V)

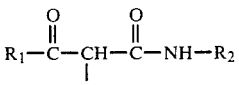

(VI)

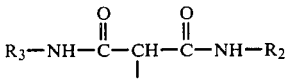

wherein $R_1$ represents an aliphatic group, an aromatic group, an alkoxy group or a heterocyclic group and $R_2$ and $R_3$ each represents an aromatic group or a heterocyclic group.

4. The silver halide color photographic material as claimed in claim 3, wherein the aliphatic group represented by $R_1$ contains about 1 to 22 carbon atoms, and said aliphatic group is unsubstituted or substituted with an alkoxy group, an aryloxy group, an amino group, an acylamino group, or a halogen atom; the aromatic group represented by $R_1$, $R_2$ or $R_3$ is a phenyl group which is unsubstituted or substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, an amino group, a hydroxy group, a carboxy group, a sulfo group, a nitro group, a cyano group, a thiocyano group, or a halogen atom; and the heterocyclic group represented by $R_1$, $R_2$ or $R_3$ is thiophene, furan, pyran, pyrrole, pyrazole, pyridine, pyrazine, pyrimidine, pyridazine, indolizine, imidazole, thiazole, oxazole, triazine, thiadiazine or oxazine.

5. The silver halide color photographic material as claimed in claim 1, wherein A is represented by the following general formula (VII), (VIII), (IX) or (X):

(VII)

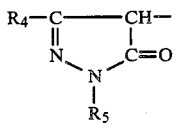

(VIII)

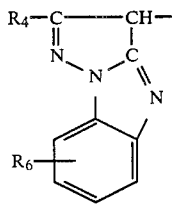

-continued (IX)

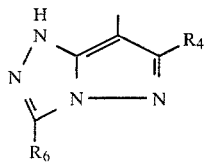

(X)

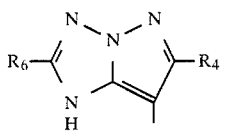

wherein $R_4$ represents a hydrogen atom, a straight or branched alkyl group having about 1 to 32 carbon atoms, an alkenyl group, a cyclic alkyl group, an aralkyl group, a cyclic alkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group or a hydroxy group;

$R_5$ represents a straight or branched alkyl group containing about 1 to 32 carbon atoms, an alkenyl group, a cyclic alkyl group, an aralkyl group, a cyclic alkenyl group, an aryl group, a substituted aryl group, a 5- or 6-membered heterocyclic ring containing a nitrogen atom, an oxygen atom or a sulfur atom as the hetero atom or a condensed heterocyclic ring group; and $R_6$ is a hydrogen atom, a straight or branched alkyl group having about 1 to 32 carbon atoms, an alkenyl group, a cyclic alkyl group, an aralkyl group, a cyclic alkenyl group, an aryl group, a heterocyclic group, a cyano group, an alkoxy group, an aryloxy group, a halogen atom, a carboxy group, an alkoxycarbonyl group, an aryloxycarbonyl group, an acyloxy group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group or a hydroxy group.

6. The silver halide color photographic material as claimed in claim 1, wherein A is represented by the following general formula (XI), (XII), (XIII) or (XIV):

(XI)

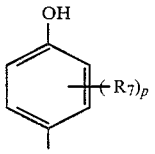

-continued (XII)

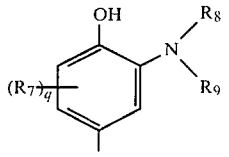

(XIII)

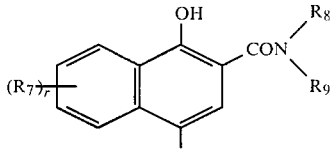

(XIV)

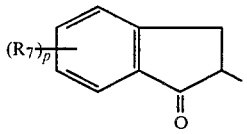

wherein $R_7$ represents a hydrogen atom, a halogen atom, an alkoxycarbonylamino group, an aliphatic hydrocarbon residue, an N-arylureido group, an acylamino group, a group —0—$R_{12}$ or a group —S—$R_{12}$, wherein $R_{12}$ is an aliphatic hydrocarbon residue;

$R_8$ and $R_9$, which may be the same or different, each represents an aliphatic hydrocarbon residue, an aryl group or a heterocyclic residue, provided that one of $R_8$ and $R_9$ may be a hydrogen atom and $R_8$ and $R_9$ may combine to form a nitrogen-containing heterocyclic nucleus;

p is an integer of 1 to 3, q is an integer of 1 or 2, and r is an integer of 1 to 4.

7. The silver halide color photographic material as claimed in claim 1, wherein A is represented by the following general formula (XV):

$$R_{10}-\underset{|}{CH}-R_{11} \qquad \text{(XV)}$$

wherein $R_{10}$ represents an arylcarbonyl group, an alkanoyl group having about 2 to 32 carbon atoms, an arylcarbamoyl group, an alkanecarbamoyl group having about 2 to 32 carbon atoms, an alkoxycarbonyl group having about 1 to 32 carbon atoms, or an aryloxycarbonyl group; and $R_{11}$ represents an arylcarbonyl group, an alkanoyl group having about 2 to 32 carbon atoms, an arylcarbamoyl group, an alkanecarbamoyl group having about 2 to 32 carbon atoms, an alkoxycarbonyl group having about 1 to 32 carbon atoms, an aryloxycarbonyl group having about 1 to 32 carbon atoms, an alkanesulfonyl group having about 1 to 32 carbon atoms, an arylsulfonyl group, an aryl group, or a 5- or 6-membered heterocyclic group containing a nitrogen atom, an oxygen atom or a sulfur atom as the hetero atom.

8. The silver halide color photographic material as claimed in claim 1, wherein said coupler represented by general formula (I) is used in a molar ratio of said coupler/a conventional photographic color coupler of 5/95 to 100/0.

9. The silver halide color photographic material as claimed in claim 8, wherein said ratio is 10/90 to 60/40.

* * * * *